US010001003B2

(12) United States Patent
Dusseault et al.

(10) Patent No.: US 10,001,003 B2
(45) **Date of Patent: *Jun. 19, 2018**

(54) MULTL-STAGE FRACTURE INJECTION PROCESS FOR ENHANCED RESOURCE PRODUCTION FROM SHALES

(71) Applicants: Maurice B. Dusseault, Waterloo (CA); Roman Bilak, Calgary (CA)

(72) Inventors: Maurice B. Dusseault, Waterloo (CA); Roman Bilak, Calgary (CA)

( * ) Notice: Subject to any disclaimer, the term of this patent is extended or adjusted under 35 U.S.C. 154(b) by 536 days.

This patent is subject to a terminal disclaimer.

(21) Appl. No.: 14/537,478

(22) Filed: Nov. 10, 2014

(65) Prior Publication Data

US 2015/0129211 A1 May 14, 2015

Related U.S. Application Data

(63) Continuation-in-part of application No. 13/578,810, filed as application No. PCT/CA2011/050802 on Dec. 22, 2011, now Pat. No. 8,978,764.

(Continued)

(51) Int. Cl.

| | |
|---|---|
| ***E21B 43/267*** | (2006.01) |
| ***E21B 47/00*** | (2012.01) |
| ***E21B 49/00*** | (2006.01) |

(52) U.S. Cl.

CPC ..... *E21B 43/267* (2013.01); *E21B 49/006* (2013.01)

(58) Field of Classification Search

CPC ..... E21B 43/267; E21B 49/006

(Continued)

(56) References Cited

U.S. PATENT DOCUMENTS 3,917,345 A * 11/1975 Davidson ..... C09K 8/80 166/280.2
4,220,205 A * 9/1980 Coursen ..... E21B 43/26 166/250.1

(Continued)

FOREIGN PATENT DOCUMENTS

CA 2735572 2/2015
WO 2008004172 A2 1/2008

(Continued)

OTHER PUBLICATIONS

PCT International Search Report and Written Opinion dated Feb. 15, 2016, for International Appication No. PCT/CA2015/051158.

(Continued)

*Primary Examiner* — Blake E Michener
(74) *Attorney, Agent, or Firm* — Patterson & Sheridan, LLP

(57) ABSTRACT

The invention relates to a method of generating an enhanced fracture network in a rock formation by the sequential stages of: i) injecting a non-slurry aqueous solution into a well extending into the formation at a rate and pressure which is close to the minimum hydraulic fracture initiation pressure and rate of the formation, until the maximum possible stimulated volume of the formation has been substantially attained to generate an outer zone of self-propping fractures; ii) injecting a first slurry of relatively fine grains of proppant to prop fractures generated in stage i within an intermediate zone located within and surrounded by the outer zone generated in stage i; and iii) injecting a second slurry comprising relatively coarse grains of to generate large fractures within an inner zone surrounded by and within the intermediate zone, in communication with the fractures generated in stages i and ii.

35 Claims, 25 Drawing Sheets

Related U.S. Application Data

(60) Provisional application No. 61/426,131, filed on Dec. 22, 2010, provisional application No. 61/428,911, filed on Dec. 31, 2010.

(58) Field of Classification Search
USPC ..... 166/250.1
See application file for complete search history.

(56) References Cited

U.S. PATENT DOCUMENTS 4,549,608 A 10/1985 Stowe et al.
4,832,121 A * 5/1989 Anderson ..... E21B 43/26 166/250.09
5,875,843 A * 3/1999 Hill ..... E21B 43/267 166/250.1
6,330,914 B1 * 12/2001 Hocking ..... C09K 8/80 166/250.1
7,210,528 B1 * 5/2007 Brannon ..... C09K 8/62 507/140
2004/0040717 A1 * 3/2004 Hill ..... E21B 43/26 166/308.1
2004/0211567 A1 * 10/2004 Aud ..... E21B 43/26 166/308.1
2005/0016732 A1 1/2005 Brannon et al.
2006/0102345 A1 * 5/2006 McCarthy ..... C09K 8/805 166/250.1
2006/0157243 A1 * 7/2006 Nguyen ..... C09K 8/805 166/280.2
2007/0199695 A1 * 8/2007 Hocking ..... E21B 43/267 166/250.1
2007/0215345 A1 * 9/2007 Lafferty ..... E21B 47/011 166/250.1
2009/0301731 A1 * 12/2009 McDaniel ..... C09K 8/68 166/372
2010/0163225 A1 7/2010 Abad et al.
2011/0120702 A1 * 5/2011 Craig ..... E21B 43/26 166/250.1
2011/0120705 A1 * 5/2011 Walters ..... E21B 43/16 166/270
2011/0120718 A1 * 5/2011 Craig ..... E21B 43/26 166/308.1
2011/0180259 A1 * 7/2011 Willberg ..... C09K 8/68 166/280.2
2012/0024530 A1 * 2/2012 Todd ..... C09K 8/03 166/308.1
2013/0105157 A1 * 5/2013 Barmatov ..... C09K 8/685 166/280.1
2014/0299315 A1 * 10/2014 Chuprakov ..... E21B 43/26 166/250.1
2014/0299318 A1 * 10/2014 Crews ..... E21B 43/267 166/280.2

FOREIGN PATENT DOCUMENTS

WO 2011/145966 11/2011
WO 2012/083463 A1 6/2012

OTHER PUBLICATIONS

Application 2011800583599, The State Intellectual Property Office, Office Action dated Jun. 2, 2015.
EPO Extended European Search Report dated Jun. 30, 2017, for European Application No. 11850531.2.

* cited by examiner

MULTL-STAGE FRACTURE INJECTION PROCESS FOR ENHANCED RESOURCE PRODUCTION FROM SHALES

CROSS REFERENCE TO RELATED APPLICATIONS

This application is a continuation-in-part of application Ser. No. 13/578,810, filed on Aug. 13, 2012, which is in turn a National Phase of PCT application No. PCT/CA2011/050802, filed on Dec. 12, 2011, and also claims Convention Priority to U.S. application No. 61/426,131, filed on Dec. 22, 2010 and U.S. application No. 61/428,911, filed on Dec. 31, 2010. The contents of said applications are incorporated herein by reference.

FIELD OF THE INVENTION

The present invention relates to extraction of hydrocarbons or other resources such as geothermal energy from a shale or other low-permeability naturally fractured formation, by hydraulic fracturing.

BACKGROUND OF THE INVENTION

Large quantities of extractable hydrocarbons exist in subsurface shale formations and other low-permeability strata, such as the Monterey Formation in the United States and the Bakken Formation in the United States and Canada. However, extraction of hydrocarbons from certain low-permeability strata at commercially useful rates has proven to be a challenge from technical, economic and environmental perspectives. One approach for extracting hydrocarbons from shale and other low permeability rocks has been to induce large scale massive fractures in the formation through the use of elevated hydraulic pressure acting on a fluid in contact with the rock through a wellbore. However, this is often accompanied by serious environmental consequences such as a large surface "footprint" for the necessary supplies and equipment, as well as relatively high costs. As well, concerns have been expressed regarding the potential environmental impact from the use of synthetic additives in hydraulic fracturing solutions. These financial and other factors have resulted in difficulties in commercial hydrocarbon extraction from shale oil beds and other low permeability strata.

In general, conventional hydraulic fracturing methods generate new fractures or networks of fractures in the rock on a massive scale, and do not take significant advantage of the pre-existing networks of naturally occurring fractures and incipient fractures that typically exist in shale formations.

A typical shale formation or other low-permeability reservoir rock, as depicted in FIG. 1, comprises the matrix rock intersected by a network of low conductivity native or natural fractures 10 and fully closed incipient fractures 12 extending throughout the formation. Such in situ natural fractures tend be on the micro-scale. FIG. 1 is a two-dimensional depiction of a three-dimensional fracture network in a rock mass with a low-permeability matrix. It is understood that in reality there are many three-dimensional effects, and that the rock mass is acted upon by three orthogonally oriented principal compressive stresses, but in FIG. 1 only the maximum and the minimum far-field compressive stresses—$_{oHMAX}$ 14 and $_{ohmin}$ 16 respectively, acting in the cross-section are represented. The natural fractures 10 and planes of weakness typically exist in a highly networked configuration with intersections between the fractures, and usually but not always with certain directions having more fractures than others, depending on past geological processes.

In their natural state, some of the fractures may be open to permit flow, but in most cases require stimulation. The majority of fractures are almost fully closed or are not yet fully formed fractures. The relative stiffness and the geological history of the rock engenders the natural formation of the network of actual and incipient fractures. The natural fractures 10 are mostly closed as a result of the elevated compressive stresses acting on the rock as depicted in FIG. 1, and because the rock mass has not been subjected to any bending or other deformation. In their closed state, fractures provide little in the way of a pathway for oil, gas or water to flow towards a production well. When closed, fractures do not serve a particularly useful role in the extraction of hydrocarbons or thermal energy.

In prior art fracture processes, sometimes referred to as "high rate fracturing" or "frac-n-pack", a fracture fluid which usually comprises a granular proppant and a carrying fluid, often of high viscosity, is injected through wellbore 18 into the injection well 19 at a high rate, for example in the range of 15-20 or more barrels per minute (bpm), often 25-40 bpm. As well, injection pressures in the range of 15,000 psi may be used to generate a highly fractured network composed essentially of artificially induced fractures. As depicted in FIGS. 2 and 3, this process tends to generate relatively large, extensive, fractures that propagate outwardly from the wellbore 18 of the injection well 19, which are essentially all propped with a proppant in order to provide flow paths for extraction of a resource. These 'conventional fractures' are typically very large fractures that extend into the far-field area of the formation away from the wellbore. In a typical sandstone reservoir, the process creates a dominantly bi-directional fracture orientation with the major induced fractures oriented at ~90° to the smallest stress in the earth, depicted as the primary fractures 20 FIG. 2. Secondary fractures 22 may form to a limited extent, as seen in FIG. 2, depending on the in situ stress state. The fluid generating the fracture is gradually dissipated across the walls of the fracture planes in the direction of the maximum pressure gradient as fracture fluid down-gradient leak-off 24 (FIG. 2). Overall, each of these fracturing events are relatively isolated and limited in terms of the overall rock volume being accessed, away from the fracture plane, during the fracturing injection process. Furthermore, conventional processes tend to extract the oil or other resource by draining the resource initially from the region remote from the well followed by progressively draining the formation closer to the well with more induced fracturing. Most conventional processes may fracture a relatively large area but are limited in the overall drainage volume from which the resource is drained following the induced fracturing step.

In prior art, high proppant concentration methods employing viscous fluids (fracturing fluids) with high contents of granular proppant (FIG. 3), said proppant also tends to be forced between the wellbore 18 and the rock 21 under a high hydraulic fracture injection rate, to create a zone 23 of proppant fully or substantially fully surrounding the injection well 19. This provides good contact (hydraulic communication) with the induced near-well fractures 8 and connecting with the primary 20 fractures emanating from the region of the wellbore 18 (FIG. 2). The large size of the hydraulic fracture wings 28 interacts with the natural stress fields 30 (FIG. 2) so that it is necessary to inject at a pressure substantially above the minimum far-field compressive stresses $\sigma_{hmin}$ 14 (FIGS. 1 and 2). In the prior art it has been described as necessary to co-inject a relatively large amount of proppant suspended within the viscous fracturing fluid to maintain the induced fractures 8 and 20 in an open state and in a state of high fluid conductivity once the high injection pressures are ceased. The fracture patterns which result from at least some prior art processes are characterized by a relatively limited bi-directional fracture orientation, with relatively poor volumetric fracture sweep because of a limited number of fracture arms/wings 28. The efficiency of interaction between the created fractures and the natural fracture flow system within the formation is believed to be low in such cases, and the lowest efficiency is associated with hydraulically induced fractures 20 of thin aperture and consisting only of two laterally opposed wings with no secondary fractures.

In certain prior art fracturing processes, liquids are deliberately made more viscous through the use of gels, polymers and other additives so that the proppants can be carried far into the fractures, both vertically and horizontally. Furthermore, in said prior art fracturing, extremely fine-grained particulate material may be added to the viscous carrier fluid to further block the porosity and reduce the rate of fluid leak off to the formation so that the fracture fluids can carry the proppant farther into the induced fractures 20, 22. Prior art fracturing is typically designed as a continuous process with no interruptions in injection and no pressure decay or pressure build-up tests i.e., no PFOT, SRT are carried out within the process to evaluate the stimulation effects upon the natural fracture network to or the flow nature of the generated interconnected extensive fracture network. Prior art fracturing processes typically do not shut down, and in some realizations, increase the proppant concentration in a deliberate process intended to create a large, single, propped fracture. In the prior art it is clear that the primary mode and intent of creating high fluid conductivity is the creation of these large isolated hydraulic fracture events (as described herein) with complex fracture fluid(s) and proppant placements, that propagate far into the formation with no significant interaction with the in situ natural fracturing systems that are present in the formation.

Methods of fracture enhancement that are currently used do not necessarily enhance shear dilation of fractures within the rock, therefore they may be sub-optimum in terms of the potential volume of rock mass contacted, which, as indicated above, is a first-order control on the success of the operation.

A conventional fracture operation typically uses a highly viscous fluid and a high injection rate. In practice, the strong opening of the hydraulic fracture near the wellbore increases the stresses across the natural fractures on either side of the induced fracture, and this tends to reduce the tendency to slip (since the frictional strength is increasing across the fracture surfaces). However, if the high pore pressures penetrate this zone, the pressures can overcome the high stresses, reducing the frictional resistance and allowing slip to take place. If the fracturing fluid is viscous, the high pressures cannot penetrate the rock mass on either side of the induced hydraulic fracture, therefore the rock mass remains "locked" as the result of the high frictional forces, and the opening mode for a single fracture is dominant—i.e. there is little or no shear displacement/dilation in the adjacent rock mass. No matter how much proppant may be placed in such a fracture, the rock mass permeability enhancement may not propagate very far beyond the induced fracture region because the pore pressure migration is impeded by the fracture fluid viscosity, therefore the stimulated volume is limited. Furthermore, a coarse-grained single-sized proppant, although it may be carried far into the single fracture, has almost no chance of entering into the secondary fractures that may be opened and connected with the induced hydraulic fracture because the aperture of these secondary fractures is substantially less than the aperture of the primary fracture. When fracturing ceases, these secondary fractures, which may have experienced very little shear displacement, are only weakly flow-enhanced and have largely closed; and therefore provide no benefit to subsequent resource extraction. The way to trigger shear (and thus conductivity enhancement) is to increase the pore pressure in the natural fracture system in as large a volume as possible, so that as many natural fractures as possible can experience shear and dilation.

In a prior art "slickwater" fracture process, one or more of a group of appropriate polymers is added to the water to reduce its frictional resistance as it moves through small aperture fractures. In typical slickwater fracturing, extremely high injection rates are employed and the goal is to develop fracture length by carrying the fracturing fluid far from the injection point to obtain enhancement in apertures from the shear dilation effect. However, the extremely high rates used, often injecting at the very top capacity of a number of pumping trucks, while it may cause impressive length growth, also results in a very large net pressure increase on the walls of the fracture (net pressure is the difference between the pressure in the fluid in the fracture and the minimum compressive stress seeking to close the fracture). Because rates are so high, this value is large, and this tends to significantly increase the locking force, which keeps the natural fractures on both sides of the induced fracture from opening easily as the result of the stress increase, which increases the frictional resistance to slip (as described above). Because the fractures are not opened so much, there is impairment in terms of the injection rate at which the induced pressures can interact with the natural fractures and allow them to slip.

SUMMARY OF THE INVENTION

The present invention relates to the use of relatively lower fracture injection rates, longer-term injection, and multi-stage and cyclic episodes of fracturing a target formation with water and proppant slurry—in order to create a large fracture-influenced volume using the natural fractures in the formation of interest to enhance the extraction of resources such as oil, gas or thermal energy from the formation.

The effectiveness of a hydraulic fracture ("HF") treatment in a naturally fractured rock mass is related to the volumetric extent of the network of natural fractures that are opened and interconnected. The effectiveness is also a function of the aperture of the fractures that are opened and interconnected within this volume, as this controls the increase in the permeability of the rock mass. This rock mass permeability increase arises because the fracture apertures are increased, which takes place by two general types of processes, opening and shearing. Opening of a fracture directly provides an aperture increase. Shear displacement of a fracture along a natural fracture surface generates an aperture because of the roughness of the opposing fracture surfaces, which generates a shear dilation when shear displacement occurs. This dilation causes the fracture aperture to increase, thereby enhancing the hydraulic conductivity.

In general, the present method of slow injection for long periods of time and staged introduction of proppant performs a combination of: a) increasing the aperture of the fractures that are pushed apart and introduce appropriately sized proppant within an inner zone adjacent the injection site and b) inducing shear dilation to provide a network of self-propping fractures within a wider zone extending beyond the inner zone. As discussed herein, shear dilation normally represents the dominant fracture conductivity enhancement process occurring more remotely from the borehole and the opening fracture, whereas within regions relatively close to the borehole, the opening mode with proppant placement is the dominant mode of fracture conductivity enhancement. In some aspects of the present method, fractures are also enhanced by engendering block rotation and wedging within the formation.

It is known in the art of rock mechanics that the earth is in a condition of differential stress, meaning that at a point (or around a well to be hydraulically fractured) there are different principal compressive stress magnitudes acting in the three principal directions. Because these three stresses are not equal, shear stresses arise as well. It was the surprising discovery of the present inventors that these and other phenomena can be harnessed to generate a wide region of "self-propping" fractures. An inner zone of propped fractures is also generated which is in fluid communication with the outer zone. In particular, applying a injection protocol (described herein) can sufficiently reduce the frictional strength across a properly oriented joint surface, which causes the joint surface to slip as a result of these shear stresses, leading to shear displacement, shear dilation, and therefore hydraulic conductivity increases. Furthermore, because the self-propping zone is generated farther from the borehole rather than near the borehole, if shearing can be enhanced, it means that the volume accessed can be enhanced/increased. Finally, it is also well known that it is not necessary to exceed the closure stress in order to trigger shearing, it is only necessary to increase the pore pressure enough so as to counteract the frictional force, at which point slip will occur, even before opening takes place.

The present invention provides an improved injection process exists that provides a multi-stage injection sequence including injection rates and pressures lower than the extremely high rates of prior art processes. This approach may achieve a result that neither overstresses the natural fractures, locking them frictionally against shear slip, nor impairing the progression of pore pressures into the naturally fractured rock system. Thus, a larger volume of highly pressured rock may in some cases be generated on each side of the induced fracture plane, and more shear displacement can take place in this pressurized volume relative to at least some prior art processes, potentially enhancing the treatment effect by increasing the volume of the rock mass experiencing shear dilation and in some cases the related mechanisms of wedging and block rotation.

In one aspect, the fracturing fluids employed in the process comprise water, saline or water/particulate slurries that are essentially free of other additives. In one aspect, the invention relates to integrating the processes for generating hydraulic fractures and enhancing the hydraulic conductivity of the natural fracturing of the formation in a manner which accelerates and improves the extraction of hydrocarbons or thermal energy.

According to one general aspect, the invention relates to a method of generating a hydraulic conductivity enhanced fracture network in a rock formation by injection of fracturing fluid through an injection well in a multi-stage injection sequence. The formation is a typical resource-bearing formation that comprises a network of native fractures and incipient fractures. The formation is characterized by a pore pressure and an initial stress state, which determines a minimal natural fracturing pressure which is required to overcome the pore pressure and cohesion of the formation. In a broad aspect, the method comprises the sequential stages of:

Stage i): injecting a non-slurry solution into said well extending into the formation at a selected pressure and rate. In one aspect, the selected pressure is slightly above the natural fracturing pressure of the formation. In other aspects, this pressure is at or slightly below this pressure. Stage i generates a relatively wide zone of enhanced fractures generated essentially by shear displacement and/or dilation of native fractures and incipient fractures within the formation. The fractures within this zone are essentially self-propping in that they maintain at least some of their capacity for fluid permeability without the introduction of proppant. Stage i is performed until the enhanced fractures substantially reach their maximal extent and no further fractures are enhanced within the formation upon continued injection of the solution at the selected rate and pressure.

Stage ii): injecting a slurry comprising a fine-grained granular proppant into said well to prop at least some of the enhanced fractures generated in stage i; thereby creating an "intermediate zone" within the outer zone generated in stage i. This stage ii may effectively "crystallize" some of the fractures generated in stage i by placing proppant within fractures located in the intermediate zone, to maintain their enhanced state wherein fluid can flow and can be extracted through such fractures. In one embodiment, this stage serves to further extend or enhance the zone of self-propping fractures by generating wedging and block rotation of native fractures within the formation. This effect may be facilitated, for example, by providing the slurry at this stage with a low density of proppant, such as less than 10%, 8%, 6% or 4% solids by volume. Stage ii may be performed at a rate and pressure higher than stage i and above or slightly above the natural fracturing pressure of the formation. The pressure and rate may be 10-50% higher than in stage i.

Stage iii): injecting a coarser-grained slurry into said formation to widen a portion of the propped fractures generated in stage ii within an inner zone which is located within the intermediate propped zone generated in stage ii. The fractures within this inner zone are widely propped relative to the stage ii fractures, to provide improved fluid communication between the fractures generated in stages i and ii, and the wellbore.

Stage iv) is optional and may consist of repeating stage i or repeating both of stages i and ii to further extend the outer and/or intermediate zones.

A resource may be extracted from the formation at various stages. The resource may be extracted after stages iii and again following stage iv. Normally, the resource would be initially extracted from zones progressively more remote from the injection site, as the zone of self-propped fractures sequentially expands during the repeated cycles of the process.

The present method generates a resulting overall fluid conductivity enhanced fracture network that comprises an innermost region closest to the wellbore and comprising widely propped fractures generated in stage iii, an intermediate region comprising narrower fractures propped with proppant generated in stage ii, and an outermost region of self-propping fractures generated in stage i. This overall enhanced fracture network can be progressively expanded further out into the formation by repeating of the various stages described herein. The determination that the maximum possible stimulated volume of the formation has been substantially attained in stages i and iv may by performed by formation response measurement data, such as surface testing for surface deformation and/or movement wherein the presence of deformation and/or movement indicates continued formation of fractures in situ, and a cessation of deformation and/or movement indicates that the maximal extent has been reached. The measurement data may be generated by performing one or more of surface tiltmeter data and monitoring well data generated by a geophone, an accelerometer and/or a pressure gauge, and formation tests. The data may identify changes in pressure within the formation and/or vibrational energy responses within the formation that are related to the injection processes and mechanics that are part of the present method.

Stage i may be repeated several times consecutively, followed by stage ii being repeated several times consecutively; or stages i and ii may be performed sequentially with such sequence of injection optionally being repeated several times; or some combination of such sequencing of stages i and ii; in order to optimize the fluid conductivity enhancement in the formation.

Determination of the minimum required fracture extension rates and fracture extension pressure may be performed using methods that are well known to persons familiar with the process of hydraulic fracturing.

In one aspect, Stage i may involve injection rates and pressures that are up to 10%, 8%, 5% or 3% above the minimum fracture rate and pressure for the formation. According to another aspect, this stage may be performed at rates and pressures that are between 0 to 10%, 0 to 8%, 0 to 5% or 0 to 3% below these levels.

Stage ii may have the same rates and pressures of injection as stage i or be at somewhat higher (for example, 10-30% increase) levels over stage i. Preferably, the injection rates and pressures are above the minimum fracture rates and pressures.

Stage iii may be performed at an injection rate and pressure which are at a higher rate and pressure of injection as compared to stages i and ii (for example, 50-100% above the stage i level).

The method may further comprise the stage of controlling and optimizing shear dilation and pore pressure increase in order to facilitate an increase in formation volume being effected resulting from stage i. The method may further comprise the step of controlling and optimizing stress rotations and fracture rotations in order to facilitate an increase in formation volume being effected resulting from stages i and/or ii.

The method may comprise cycling sequentially for a plurality of cycles of stages i, ii and iii, or repeating any one of stages i, ii and iii, or repeating any pair of stages i, ii and iii.

Preferably, the aqueous solution comprises water or saline that is essentially free of additives.

In a further aspect, stage ii follows stage i with essentially no time gap. Stages ii and/or iii may comprise a sequence of discrete water injection steps followed by episodes of injection of said proppant. The method may comprise performing a plurality of cycles each comprising stages i through iii and providing a shut-in period or resource production period between said cycles. Furthermore, any one of stages i through iv may be repeated multiple times in sequence.

The method may comprise the further step of determining the magnitude of the deviating stress state within the formation and increasing the duration of said stages i and/or ii in response to the presence of a relatively high deviating stress state.

In one aspect, the invention specifically seeks to maximize the fluid conductivity change in a large volumetric region around the injection point so as to induce large changes in stress in a large volume of the rock mass surrounding the stimulation site, leading to opening of natural fractures, shearing of natural fractures, and developing incipient fractures into actual open fractures. A suitable target formation is shale, although it is contemplated that the method described herein or variants thereof may be adapted for use in any other low permeability rock type, such as less than about 10 milliDarcy.

Definitions

The terms below shall have the meanings defined below within this patent specification, unless the contrary is stated or the context clearly requires otherwise.

"formation" means: a layer or limited set of adjacent layers of rock in the subsurface that is a target for commercial exploitation of contained hydrocarbons or other resource and therefore may be subjected to stimulation methods to facilitate the development of that resource. It is understood that the resource can be hydrocarbons, heat, or other fluid or soluble substance for which an interconnected fracture network can increase the extraction efficiency.

"Slurry Fracture Injection" and interchangeably "SFI" are trademarks, and refer to a process comprising the injection of a pumpable slurry consisting of a blend of sand/proppant with mix water into a formation at depth under in situ fracturing pressures, employing cyclic injection strategies, long term injection periods generally on the order of 8-16 hrs/day for up to 20-26 days/month, and using process control techniques during injection to: optimize formation injectivity, maximize formation access, and maintain fracture containment within the formation.

"fracture" means: a crack in the rock formation that is either naturally existing or induced by hydraulic fracturing techniques. A fracture can be either open or closed.

"enhanced" means: an improvement in the aperture, fluid conductivity, and/or hydraulic communication of a fracture that is either natural or induced by hydraulic fracturing techniques.

"Natural fractures" or interchangeably "native fractures" mean: surfaces occurring naturally in the rock formation i.e., not man-made that are fully parted although they may be in intimate contact or surfaces that are partially separated but normally remain in intimate contact and are considered planes of weakness along which fully open fractures can be created.

"incipient fracture" means: a natural fracture that is fully closed and incompletely formed in situ but that is a plane of weakness in parting and can be opened and extended through the application of appropriate stimulation approaches such as SFI™.

"induced fracture" or "generated fracture" mean: a fracture or fractures created in the rock formation by man-made hydraulic fracturing techniques involving or aided by the use of a hydraulic fluid, which in the present process is intended to be clear water along with additives such as friction reducers to aid the hydraulic fracturing process.

"slurry" means: a mixture a granular material sand/proppant along with clear water, which may or may not have additional additives for friction control and fracture development control.

"proppant" refers to a solid particulate material employed to maintain induced fractures open once injection has ceased, generally consisting of a quartz sand or artificially manufactured particulate material in the size range of 50 to 2000 microns (0.002 to 0.10 inches) in diameter. Herein, the words proppant and sand are usually employed interchangeably.

The abbreviation PFOT means Pressure Fall-Off Test

The abbreviation SRT means Step-Rate Test

"propped" refers to a fracture that is at least partly maintained in an open state by the presence of a proppant within the fracture.

"self-propped" refers to a fracture that contains no introduced proppant and is maintained in an enhanced state that is sufficiently dilated to permit a selected fluid to permeate through the fracture, by a physical state or configuration of the rock other than the presence of a proppant. Examples include fractures that are dilated by shear whereby the natural roughness of the fracture surfaces spaces portions of the fracture wall apart due to natural roughness of the rock surfaces; as these surfaces are displaced relative to each due to shearing forces, portions of the surfaces become spaced apart.

The intended meanings of other terms, symbols and units used in the text and figures are those that are generally accepted in the art, and additional clarifications are given only when the use of such terms deviates significantly from commonly accepted meanings.

DETAILED DESCRIPTION

Figure 1:
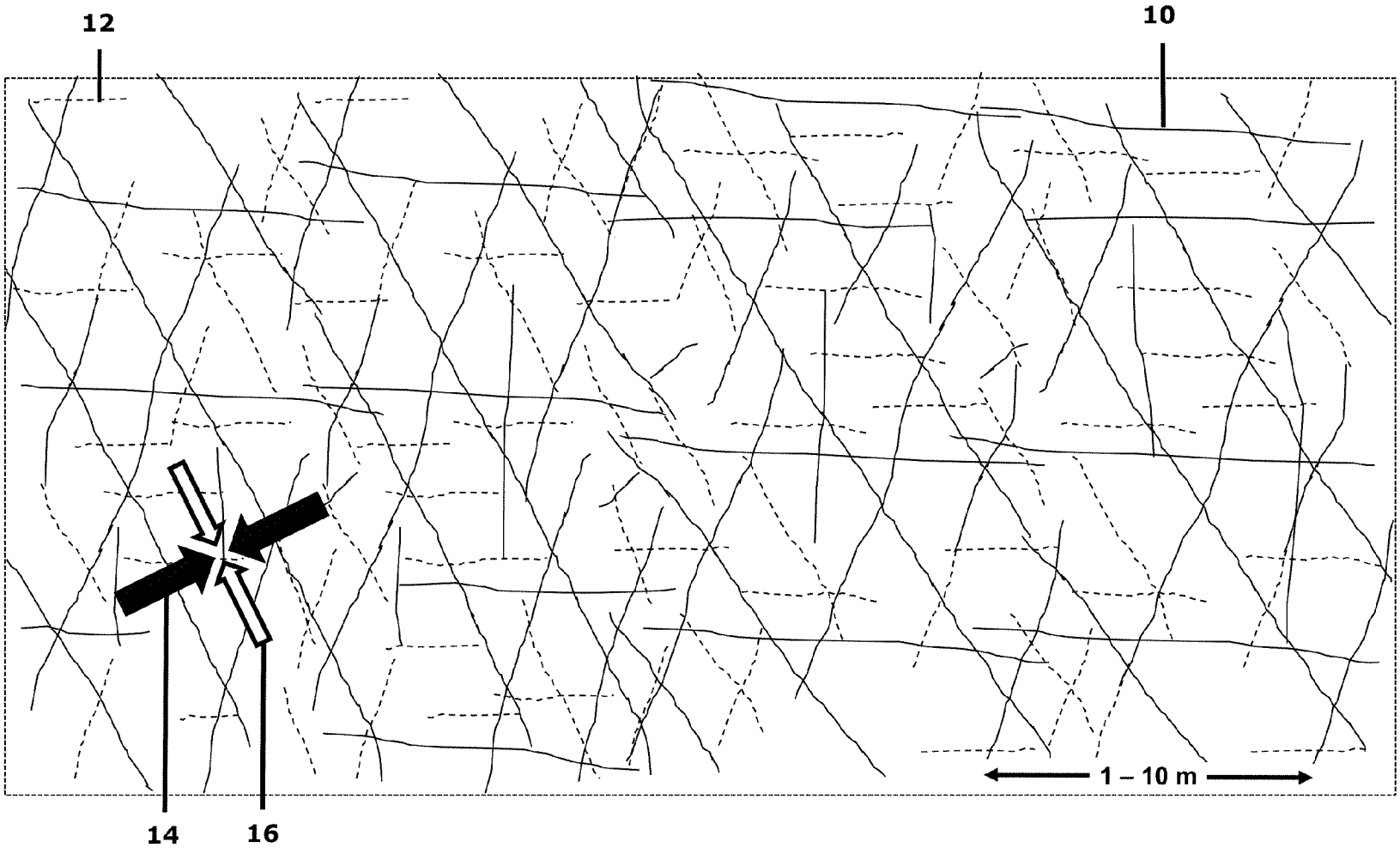
FIG. 1 is a schematic depiction of a cross-section of a typical shale formation.

FIG. 1 is a schematic depiction of a cross-section of a shale formation, showing natural (native) fractures 10 in a substantially closed state and incipient fractures 12. The depiction is oriented as a horizontal cross-sectional plane of a three-dimensional rock mass, and in the depiction, the two principal far-field compressive stresses act orthogonally along the plane of the cross-section. The maximum and the minimum far-field compressive stresses are termed $\sigma_{HMAX}$ and $\sigma_{hmin}$ respectively, depicted as arrows 14 and 16. These stresses $\sigma_{HMAX}$ and $\sigma_{hmin}$ are also termed $\sigma_2$ and $\sigma_3$ respectively, whereby $\sigma_2>\sigma_3$; $\sigma_3$ is referred to as the minimum principal stress. The third principal stress acting on the rock mass is the vertical stress termed $\sigma_v$ and is perpendicular to the horizontal cross-sectional plane shown in FIG. 1 ($\sigma_v$ is not labelled on the figure); $\sigma_v$ is also termed $\sigma_1$, whereby $\sigma_1$, $>\sigma_2>\sigma_3$; $\sigma_1$ is referred to as the maximum principal stress. The depicted orientation of these two principal far-field compressive stresses ($\sigma_{HMAX}$ and $\sigma_{hmin}$) is not intended to represent any preferred direction, but is simply a representation of said stresses. It is understood that in a three-dimensional rock mass, there exist three of said compressive stresses, different from each other, acting orthogonally upon the rock mass. In general, the natural fractures 10 are kept closed or compressed by said far-field compressive stresses.

Figure 2:
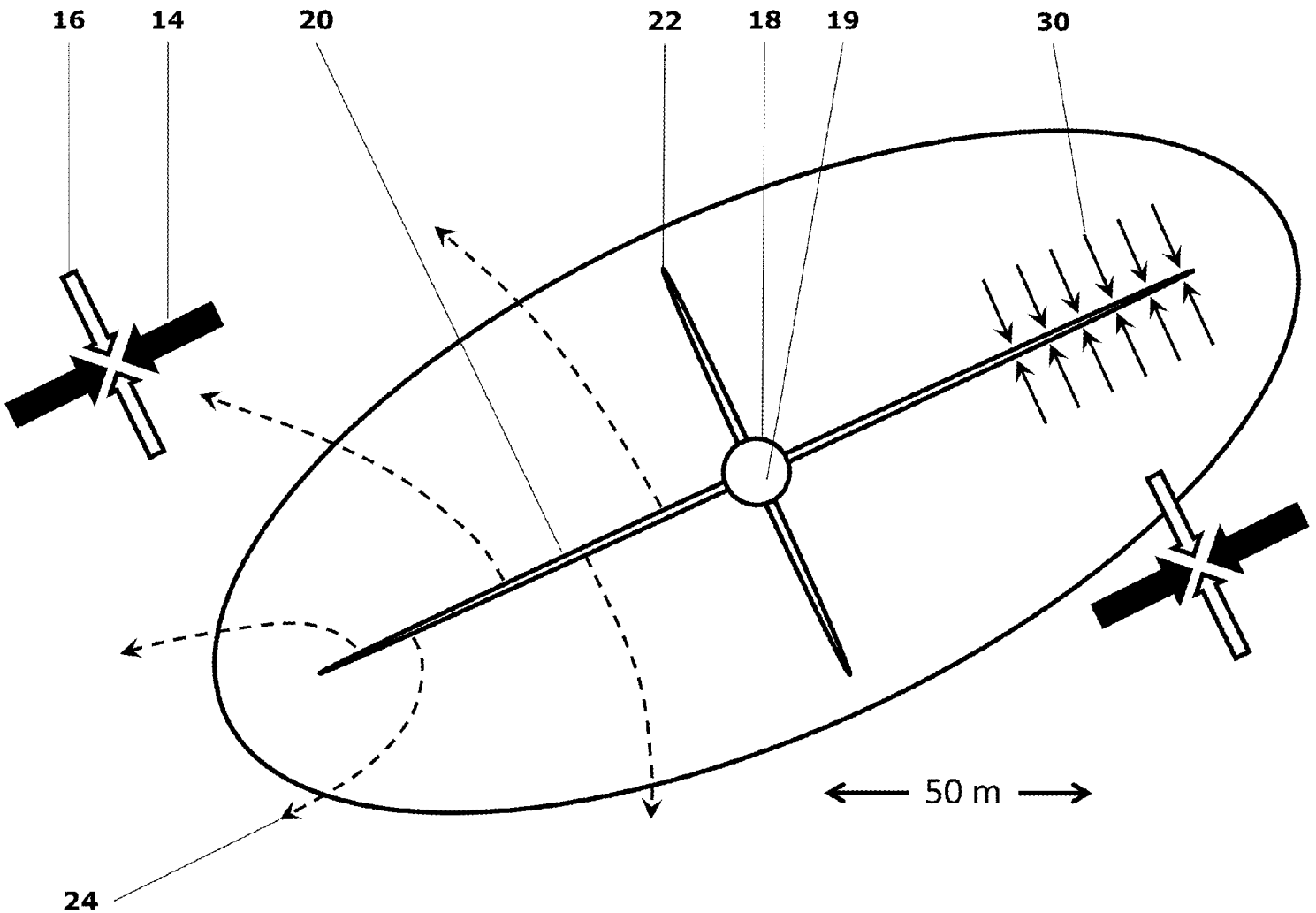
Figure 2 (Prior Art)
FIG. 2 is a cross-sectional schematic drawing of a hydraulically fractured formation generated according to a prior art method.

FIG. 2 is a cross-sectional depiction of a hydraulically fractured formation generated according to a prior art method, showing typical primary fractures 20 and secondary fractures 22 which may also contain within them placed deposits of proppant extending far within the formation following the planar openings generated by the hydraulic fracturing process. The thickness of the induced and propped fracture planes is exaggerated for demonstration purposes; in stiff rocks under large compressive stresses, they are rarely more than 10-20 mm thick. Fracturing is generated by fluids pumped at high rates and pressures (well above the minimum requirement for fracturing the rock) into the formation through wellbore 19 of well 18.

Figure 3:
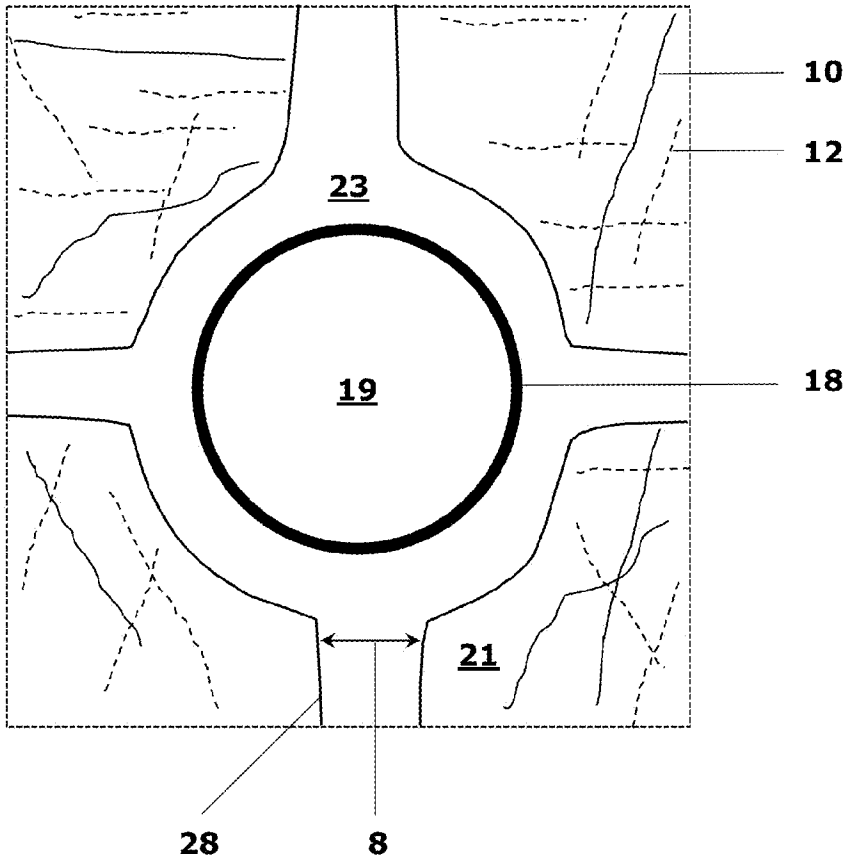
Figure 3 (Prior Art)
FIG. 3 is a further cross-sectional schematic drawing of a prior art fractured formation.

FIG. 3 is a cross-sectional depiction of a prior art fractured formation in the near-wellbore region, showing the creation of a zone 23 of proppant fully or substantially fully surrounding the well 19 and in the part of the induced fractures 8 near the well 19, showing the communication between the well 19 and the induced fractures 8. Well 19 comprises a casing 18.

Figure 4:
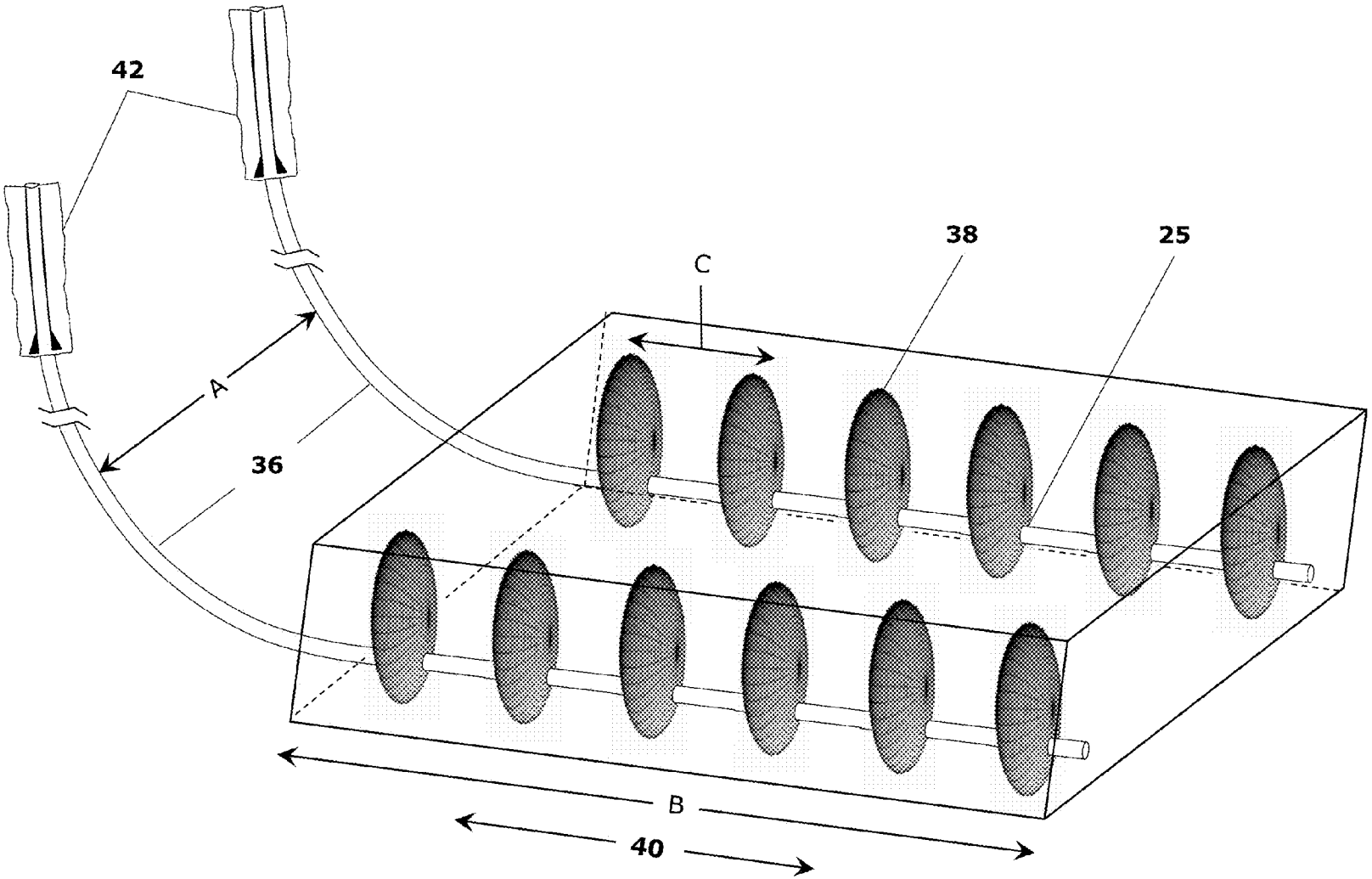
FIG. 4 is a schematic drawing of a formation showing injection wells.

FIG. 4 is a depiction of a subsurface formation, with a pair of injection wells 36 which may generally horizontal or generally parallel to the strata dip. FIG. 4 also illustrates in detail a horizontal injection segment of two wells 36, which may include in one embodiment as many as 45 zones of perforated openings along its length, each length of perforations constituting a site to be employed for the generation of a corresponding fracture stimulation zone within the formation using the present process. Typical spacing "A" between injection wells 36 ranges from about 50 to 500 meters, although it is understood that in practice other dimensions may be required. Each injection well 36 has been subjected to a series of hydraulic fracture injection stimulations 38 along its length. Each wellbore is a cemented-in-place steel casing 36 of suitable diameter for injecting slurries and other fluids at the rates and pressures described herein. Typical length of the well is about 500 to 2000 meters. These are typical ranges of well lengths and spacing, and in practice other values may be required. At sites selected and spaced along the length of the horizontal section in the target formation, a perforated site 25 is created in the steel casing. Then, at each perforated site, a hydraulic fracture injection stimulation has been implemented on a stand-alone, sequential basis. Each hydraulic fracture injection stimulation involves a number of stages (as described in this present invention) performed in a low permeability target formation such as a shale or siltstone. In this manner, a long horizontal well, can be effectively stimulated along its entire length. The dilated zone 38 within the formation that is affected in terms of natural fracture dilation and induced fracture placement is generally in the three-dimensional configuration of an ellipsoid of which the narrow axis is oriented parallel to the minimum stress direction in situ $\sigma_3$ 40. It is understood that the choice of a horizontal or near-horizontal well orientation in this figure does not precludes the use of the present method in vertical or inclined wells, which may be preferred in some circumstances such as unusual stress fields, pre-existing steel-cased wells, unavailability of horizontal well drilling capability, and so on.

FIG. 4 also depicts a cemented surface casing 42 providing extra protection to the existing shallow groundwater formations against any accidental interaction of the fracturing fluid with the shallow formations.

Figure 5:
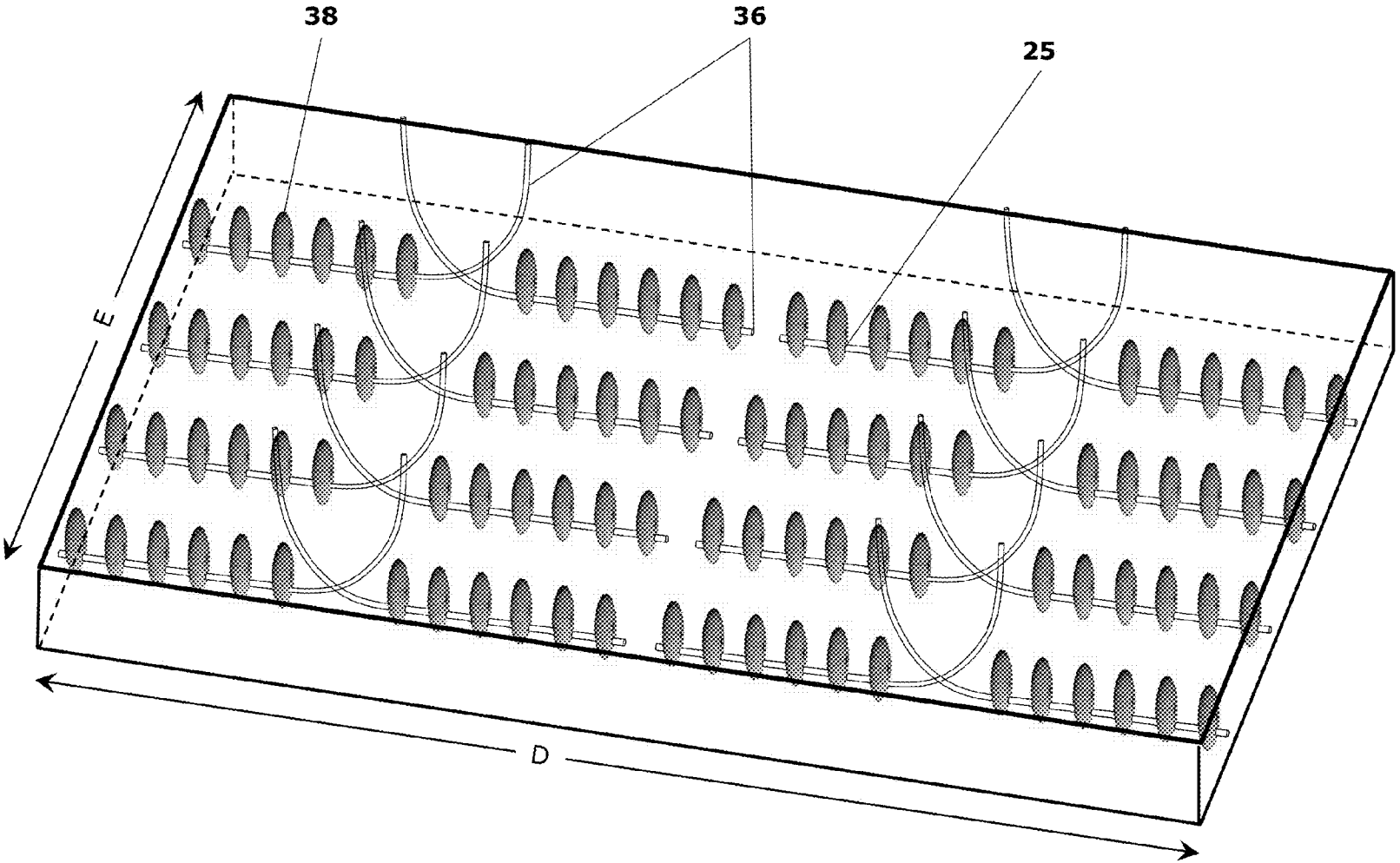
FIG. 5 is a further schematic drawing of a formation showing injection wells.

The hydraulic fracture injection stimulation events depicted in FIGS. 4 and 5 rely on the provision of one or more wellbores 36, vertical or horizontal, arranged to provide access to the target formation at one or more locations along the injection well 36 or wells 36. In one possible configuration, as depicted in FIG. 4, wellbores 36 are drilled and as the target formation is approached, the wellbores 36 are deviated to form long horizontal segments in the target formation. A steel casing is lowered into the well and cemented in the standard manner described by prior art. Along the length of the horizontal well, specific locations are identified and openings are created through perforating the steel casing to allow access to the formation. The perforated site 25 can be approximately 2-3 m long and once perforated can contain no less than 50 openings of diameter no less than 12 mm, although it is understood that these are typical ranges, and in practice other dimensions may be required. A number of similar horizontal wells may be drilled into the target formation, either parallel to each other, as depicted in FIG. 5, or in some other disposition, such as combining horizontal, vertical and inclined wells, deemed sufficient to contact the formation at the desired spacing. These wellbores 36 are also equipped with cemented steel casing and perforated to gain access to the strata behind the cemented casing.

FIG. 5 depicts subsurface formations, showing a more extensive array of injection wells to provide coverage of a reservoir. In one non-limiting example, the wells are about 3000 to 6000 meters in length with inter-well spacing of about 50 to 300 meters. There are multiple dilated zones 38 (caused by the hydraulic stimulation events described in this present invention) along the axis of each injection well, with each dilated zone 38 being treated according to the method described herein to generate a stimulated volume comprising both the region of proppant injection into natural fractures 10 and the surrounding region within which the natural fracture system has been enhanced by the present process through increases in aperture because of the mechanisms induced through the present process (FIG. 1 above).

FIG. 5 depicts an essentially horizontal or gently dipping injection array installed within a generally horizontal or gently dipping shale formation or other low permeability formation. It will be evident that a suitable target formation may also be disposed in tilted or curved orientation and the field of injection wells may be likewise disposed in a tilted and/or curved plane. Typically, the rows of injection wells may be spaced between 50 and 500 meters apart as indicated in FIG. 4, although the inter-row spacing will vary depending on the characteristics of the formation and other factors.

The present method comprises a staged approach to the generation of an extensive conductive and interconnected fracture network within the formation surrounding the wellbore 36 in order to facilitate and accelerate the extraction of hydrocarbons or thermal energy. The entire process is applied at one perforated site 25 along the wellbore 36 and in a series of designed stages, before moving to another perforated site 25 along the same or another wellbore 36. Once the hydraulic fracture stimulation process is completed at that perforated site 25, another perforated site 25 along the wellbore 36 is isolated, and the process is repeated at the new perforated site 25, modified as necessary to account for the effects of previous stimulations along the wellbore 36. This sequential and staged stimulation of a number of perforated sites 25 along the wellbore 36 continues until all of the perforated sites 25 have been appropriately stimulated, then a new wellbore 36 may be treated.

Figure 6A:
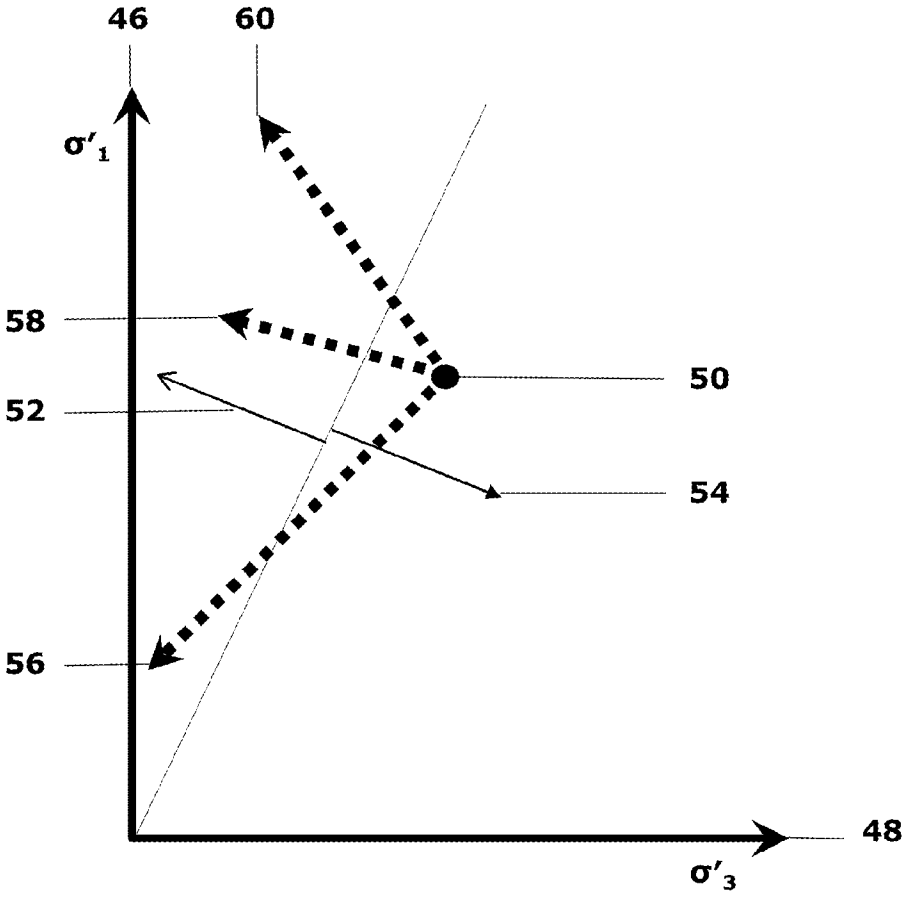
FIGS. 6A and 6B are schematic drawings showing typical stress changes and resulting shearing within a formation during the application of the present method.
Figure 6B:
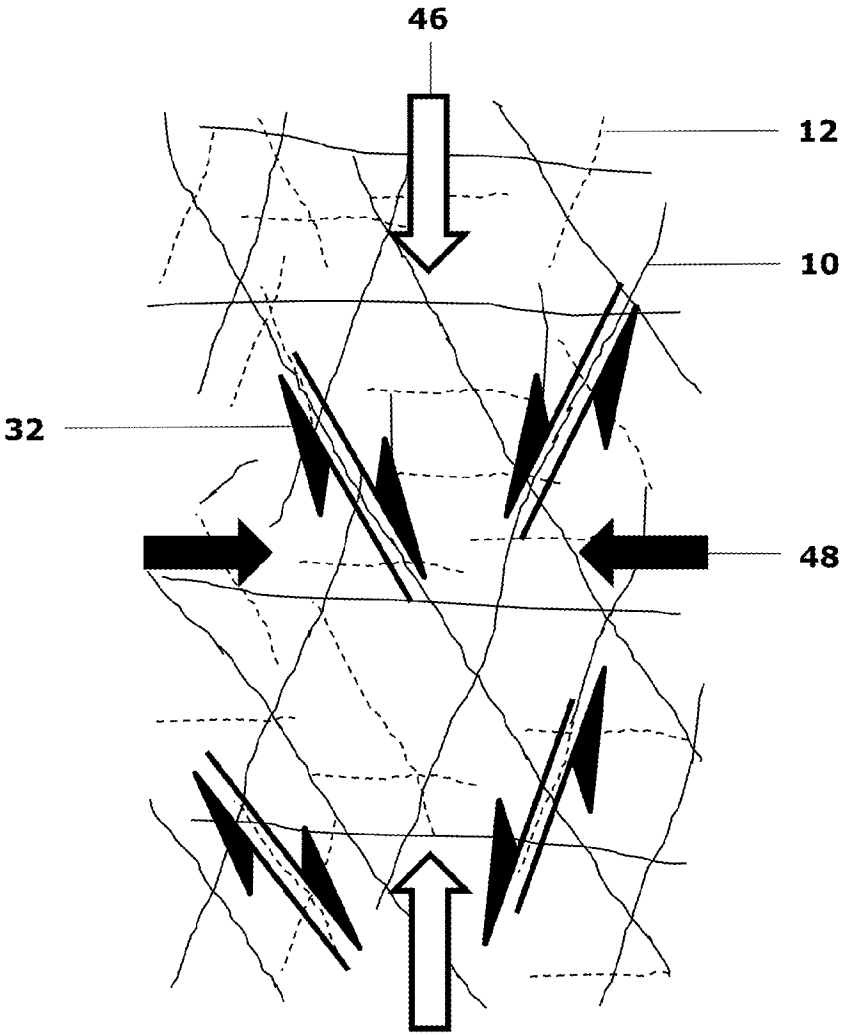

FIGS. 6A and 6B depict typical stress changes and resulting shearing within a formation during the application of the present method. FIG. 6A depicts the tendency to shear and is plotted on principal effective stress axes where $\sigma'_1$ and $\sigma'_3$ represent the greatest and the least principal effective stress, respectively, the orientation of which is not stipulated. FIG. 6A depicts the typical initial stress state 50, as well as stress conditions defined as the shear slip regions 52 where shearing will take place and the no shear slip region 54 where shearing does not occur. The term 'shear slip' is widely known by person skilled in the art to refer to a shearing movement; and the term "effective stress" is widely known by persons skilled in the art to refer to the difference between the global compressive stress in a given direction and the pore pressure, such that when the pore pressure becomes equal or greater than the compressive stress in that direction, conditions suitable for natural fracture 10 opening or shear displacement 32 are reached. Typical stress paths to achieve the slip condition are a first path 56 to generate shear slip with increasing pore pressure (decreasing $\sigma'_1$ and decreasing $\sigma'_3$) by injection of fluid, a second path 58 to slip with decreasing $\sigma'_3$, and a third path 60 to slip with increasing $\sigma'_1$ and decreasing $\sigma'_3$ (FIG. 6A).

FIG. 6B depicts suitably oriented natural fractures 10 in the rock mass that exhibit shear displacement 32 once the stresses and pressures on that natural or incipient shear plane have reached critical conditions for slip (as per FIG. 6A). FIG. 6B depicts a relatively large number of such planes in a rock mass, thereby indicating that a suitably designed and executed fracture stimulation treatment by the present method will activate many such planes.

Figure 7A:
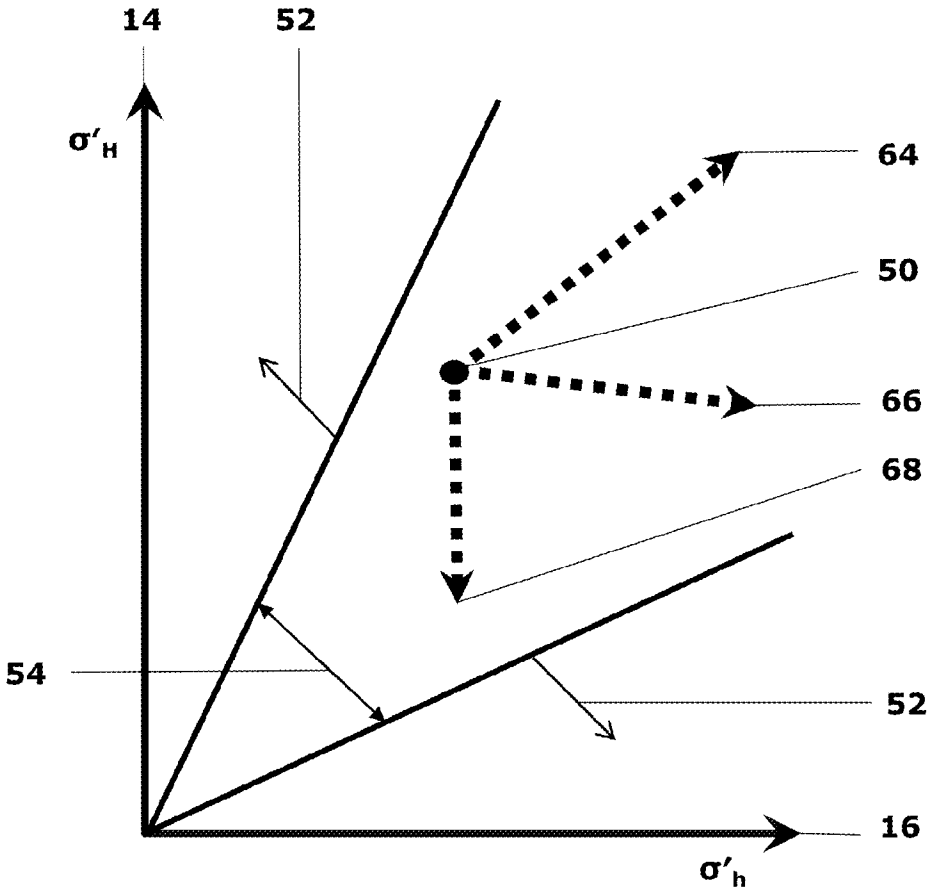
FIGS. 7A and 7B are further schematic views of typical stress changes within a formation during the application of the present method.
Figure 7B:
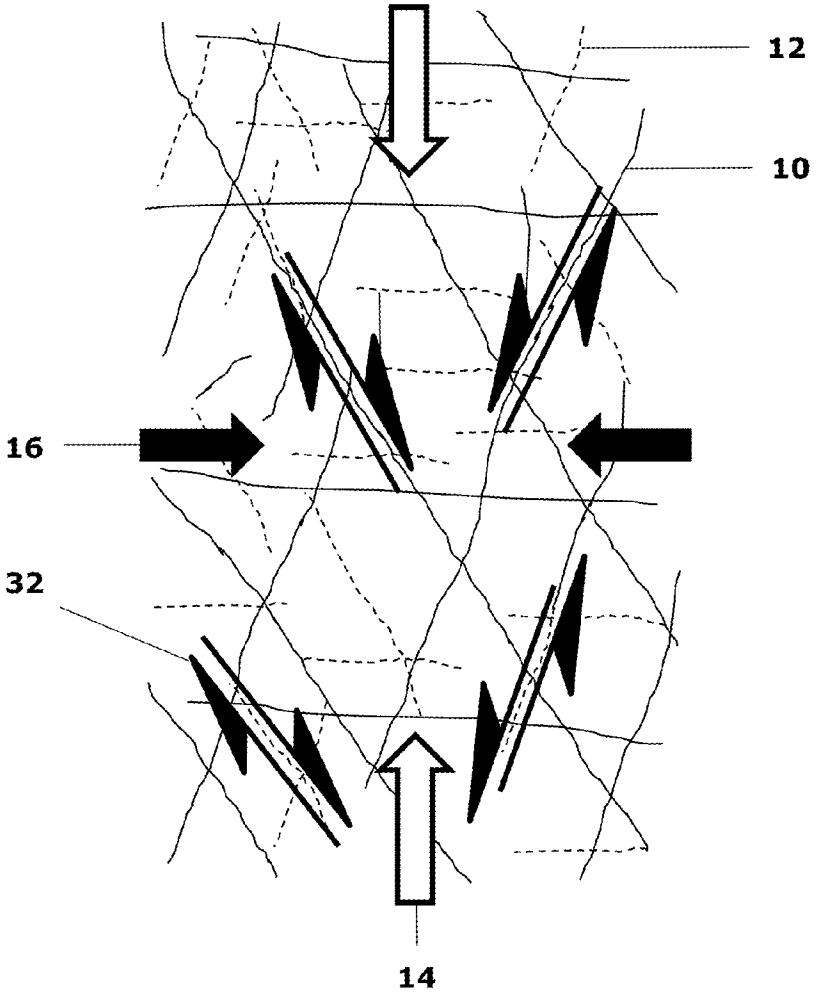

FIGS. 7A and 7B depict alternative shearing responses within the formation. FIG. 7A depicts effective compressive stress in the original direction of the maximum $\sigma'_H$ 14 and the minimum $\sigma'_h$ 16 far-field stresses, which fixes the diagram to represent, as the chosen example, a horizontal planar cross-section. Typical stress paths are a no-slip path 64 that can result from decreasing the pore pressure (increasing $\sigma'_H$ and increasing $\sigma'_h$), a path 66 that slips as a result of increasing $\sigma'_h$, and a path 68 that can slip as a result of decreasing $\sigma'_H$ (FIG. 7A). A decrease in the pore pressure due to fluid withdrawal does not lead to a condition of opening or shear displacement. The central area is thereby, in this depiction of the process, as a stable "no shear" slip region 54 within which shear slip does not occur. The depicted stress paths are intended to demonstrate that there are many stress paths that may not lead to shear slip, or that are improbable stress paths for shear and dilation. This depiction is intended to demonstrate the vital importance of rock mechanics principles in understanding and implementing the present method. Large changes in the stresses and pore pressures in a naturally fractured system act on fractures in specific orientations and assist opening these fractures by increasing the parting pressure or cause shear displacement along the fractures by a combination of increasing pore pressure and stress changes, both processes tending to increase the permeability of the rock mass.

Overview of the Enhanced Fracture Network

Figure 8A:
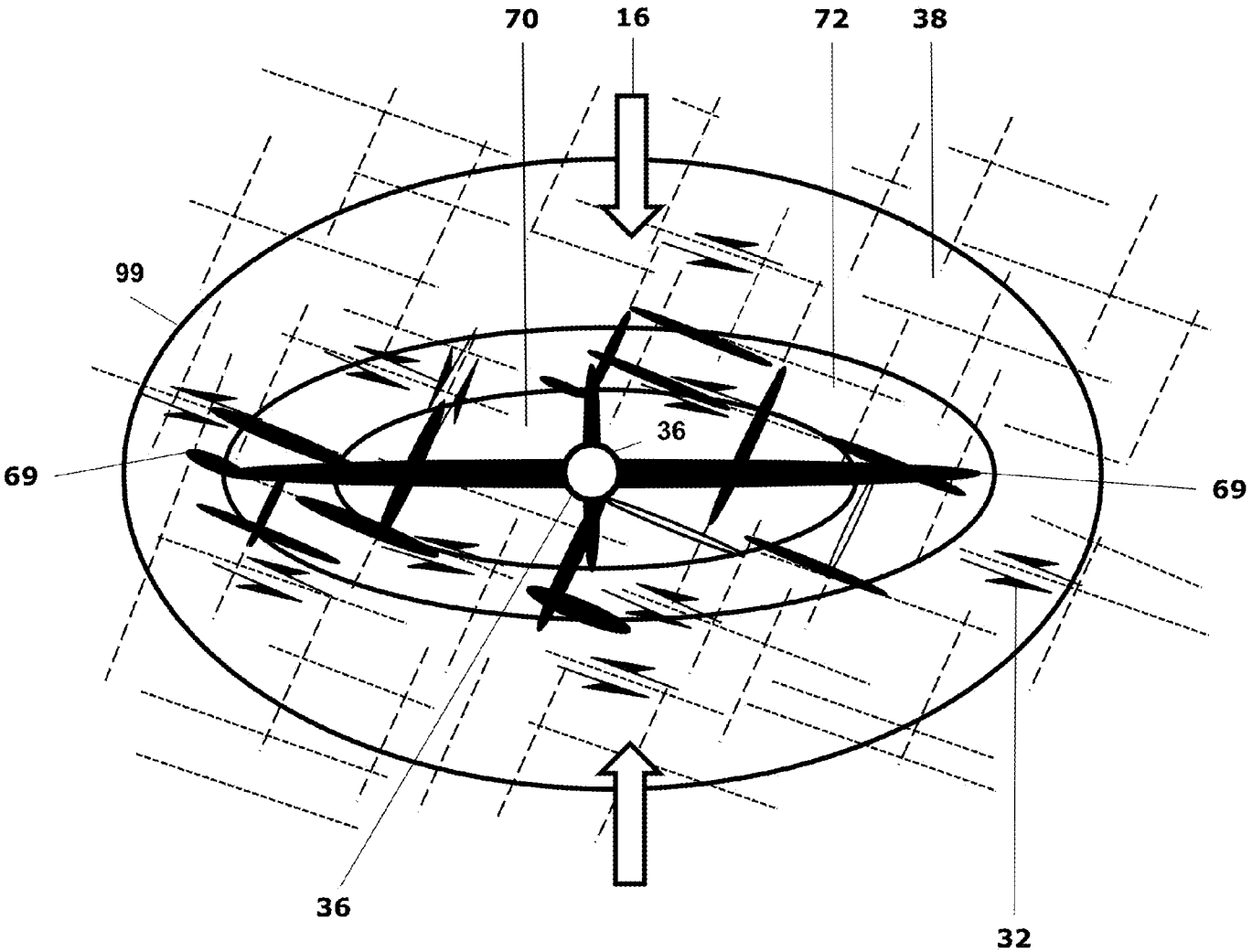
FIG. 8A is a cross-sectional depiction of a shale formation, showing fractures treated according to the invention.

FIG. 8A is a cross-sectional depiction of a shale formation, showing a network of natural fractures and incipient fractures 10 that have been wedged, sheared, and propped open to become open natural fractures 69. This occurs as a result of the changes in volume and changes in stresses and pressures according to the present method; such conductivity enhanced system is maintained and accessed by the introduction of proppant in induced fractures 8 according to the present method. FIG. 8A depicts a vertical wellbore 36 accessing the formation, and it is understood that this is only one example and that any orientation of well may in principle be used.

Immediately surrounding the wellbore 36 is a roughly ellipsoidal innermost zone 70 that defines the region within which the coarse-grained proppant has been introduced in stage iii of the present process.

Surrounding zone 70 is a larger intermediate zone 72 within which the fine-grained proppant placed in stage ii of the present process extends.

Surrounding the stage ii zone 72 is a still larger outmost zone 38 to which the propping agent has not reached, called the dilated zone 38 developed in stages i and iv of the present process. Fractures within this zone are self-propped. The combination of zones 70, 72 and 38 encompasses the aggregate of the entire stimulated rock volume that has been affected by the process. This combination of zones constitutes a stimulated rock volume zone 99. Zone 99 includes propped fractures and unpropped fractures (i.e. self-propped) that are opened sufficiently to permit fluid flow by the shearing and dilation processes caused by injection of a non-slurry solution in stages i and iv described herein. The stimulated zone 99 is roughly ellipsoidal in shape with its narrowest axis parallel to the far-field minimum principal compressive stress direction 16, and it is the region within which fluids can move more easily because of an enhanced permeability arising from the application of the present method. By virtue of the large changes in stress and pressure deliberately induced by the present process, many of the natural fractures 10 have had their apertures significantly increased by processes such as high pressure injection, wedging, shear, and also through the small rotations of the rigid rock blocks (refer to FIGS. 8B-C) in reaction to the large volume changes that are being enforced during all stages.

Figure 8B:
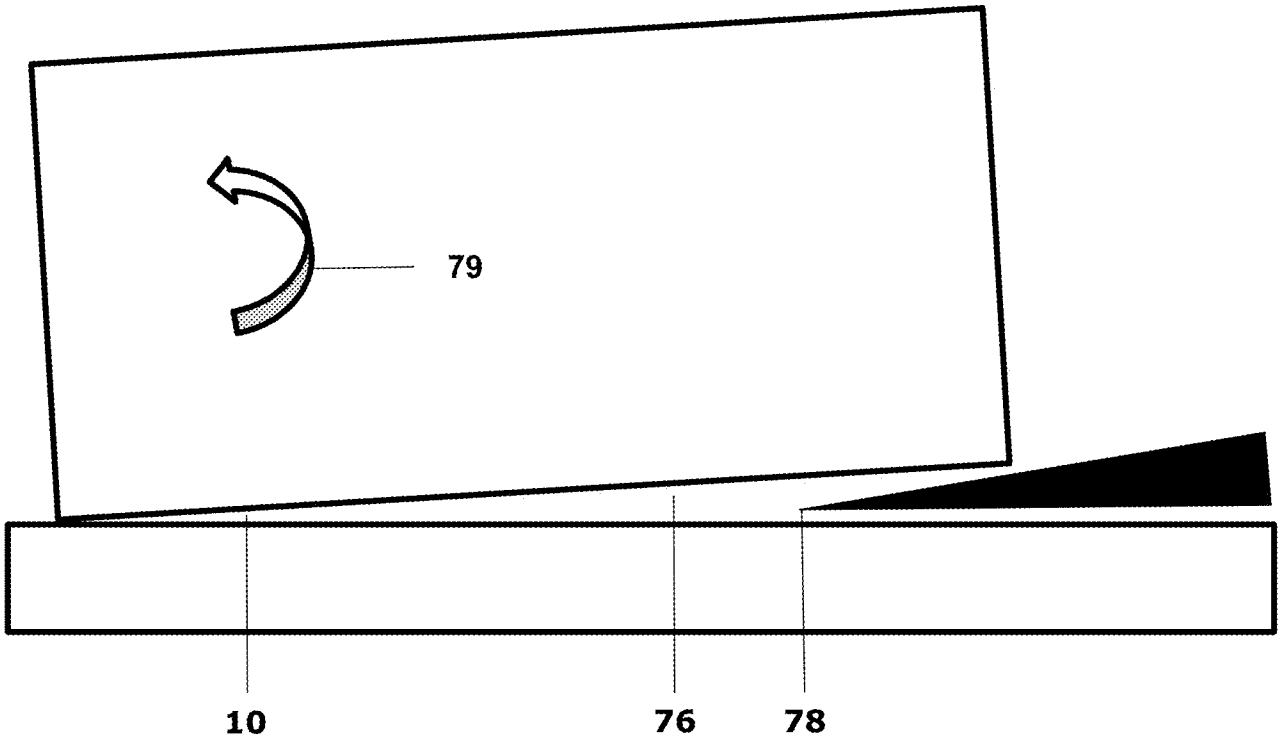
FIG. 8B is a schematic view of a fracture that depicts the wedge-effect resulting from forcing proppant into the fracture with concurrent rigid block movement of the formation face along the fracture.
Figure 8C:
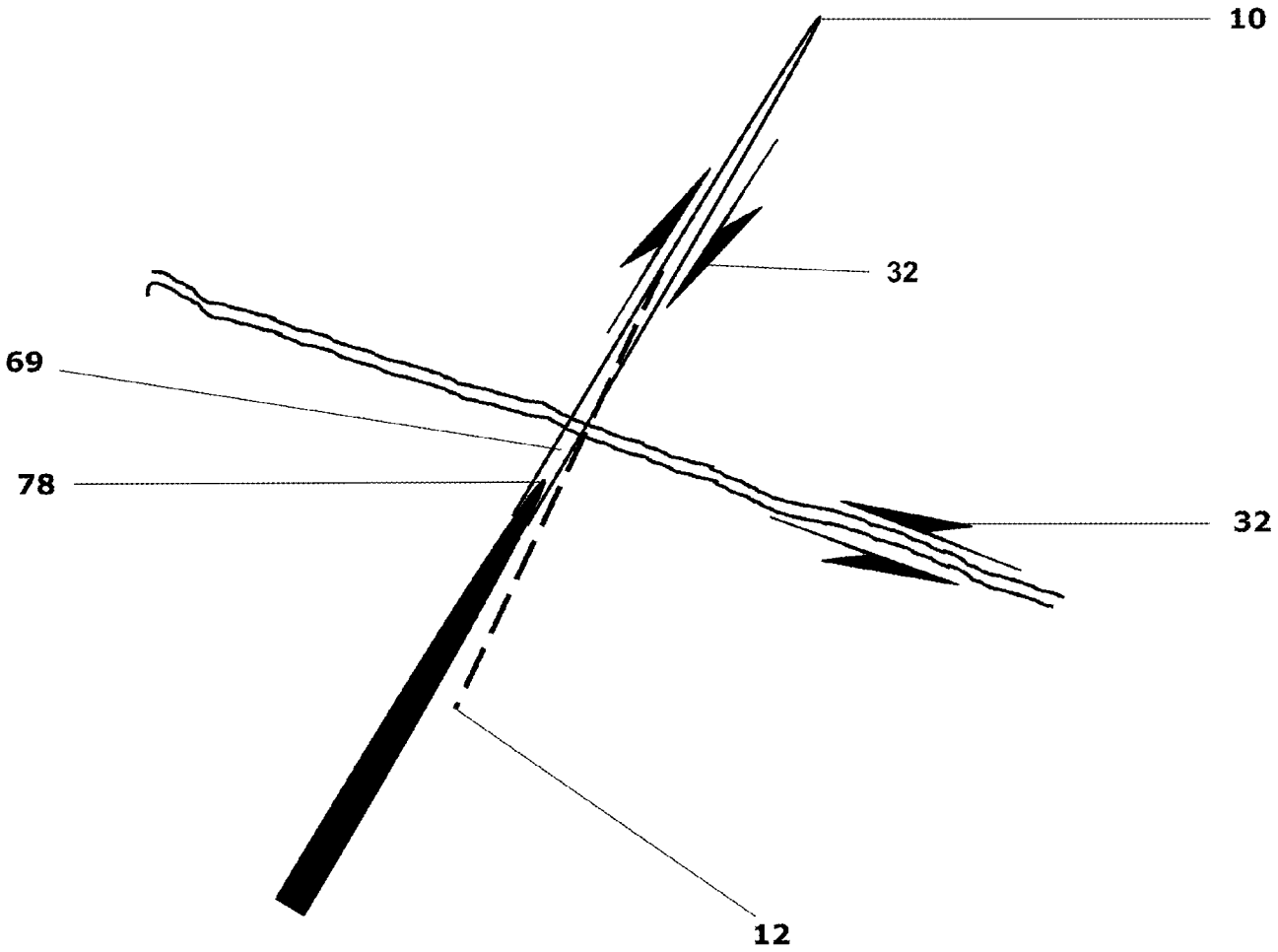
FIG. 8C is a schematic view of fractures depicting a hydraulic fracture and a proppant wedge-effect interacting with natural fractures.

Development of a wide, propped zone, as per stages ii and iii in the present process, leads to wedging and rigid block motion in a stiff, naturally fractured rock. Wedging is seen as opening of the fracture aperture between blocks (due to proppant placement 78 in the fracture), and shear displacement implies conductivity increases through shear dilation and self-propping. The stimulated natural fractures within zone 99 will in embody both of these mechanisms; the stimulated natural fractures within zone 99 will generally extend significant distances beyond the proppant tip 78 by processes such as wedging (FIG. 8B), and by hydraulic parting and shear (FIG. 8C). Specifically, FIG. 8B depicts how forcing proppant into a fracture 76 will wedge open and extend opening of the natural fractures 10 far from the proppant tip 78; this wedge-effect of forcing proppant into the fracture will also result in a concurrent rigid block movement (79) of the formation face along the fracture. FIG. 8C further depicts a hydraulic fracture and a proppant wedge 78 interacting with a natural fracture 10, in which the normally closed fracture is wedged open by the introduction of a proppant to become an open natural fracture 69. As this proppant-induced wedging occurs, the natural fracture 10 can also undergo further shear displacement 32, which serves to widen the aperture at an unpropped portion of the fracture 10. Finally, it is noted that although the opened natural fractures 69 containing proppant are depicted by thin ellipses, such networks are actually the hydraulically opened networks of natural fractures and hydraulically opened incipient fractures that have been partially filled with proppant.

Figure 9A:
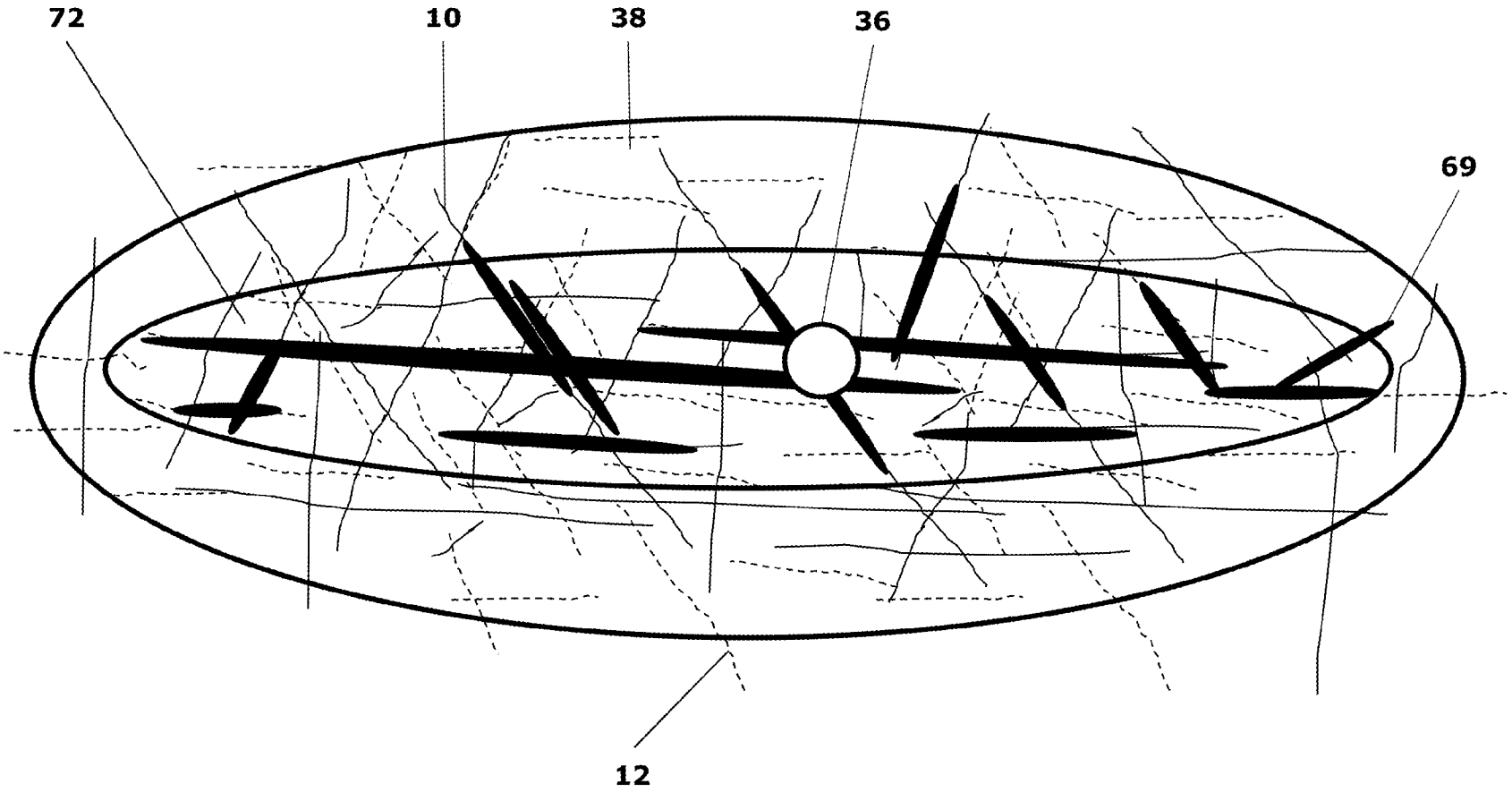
FIGS. 9A and 9B are schematic views of a formation depicting the results of a typical stimulation process using the present method.
Figure 9B:
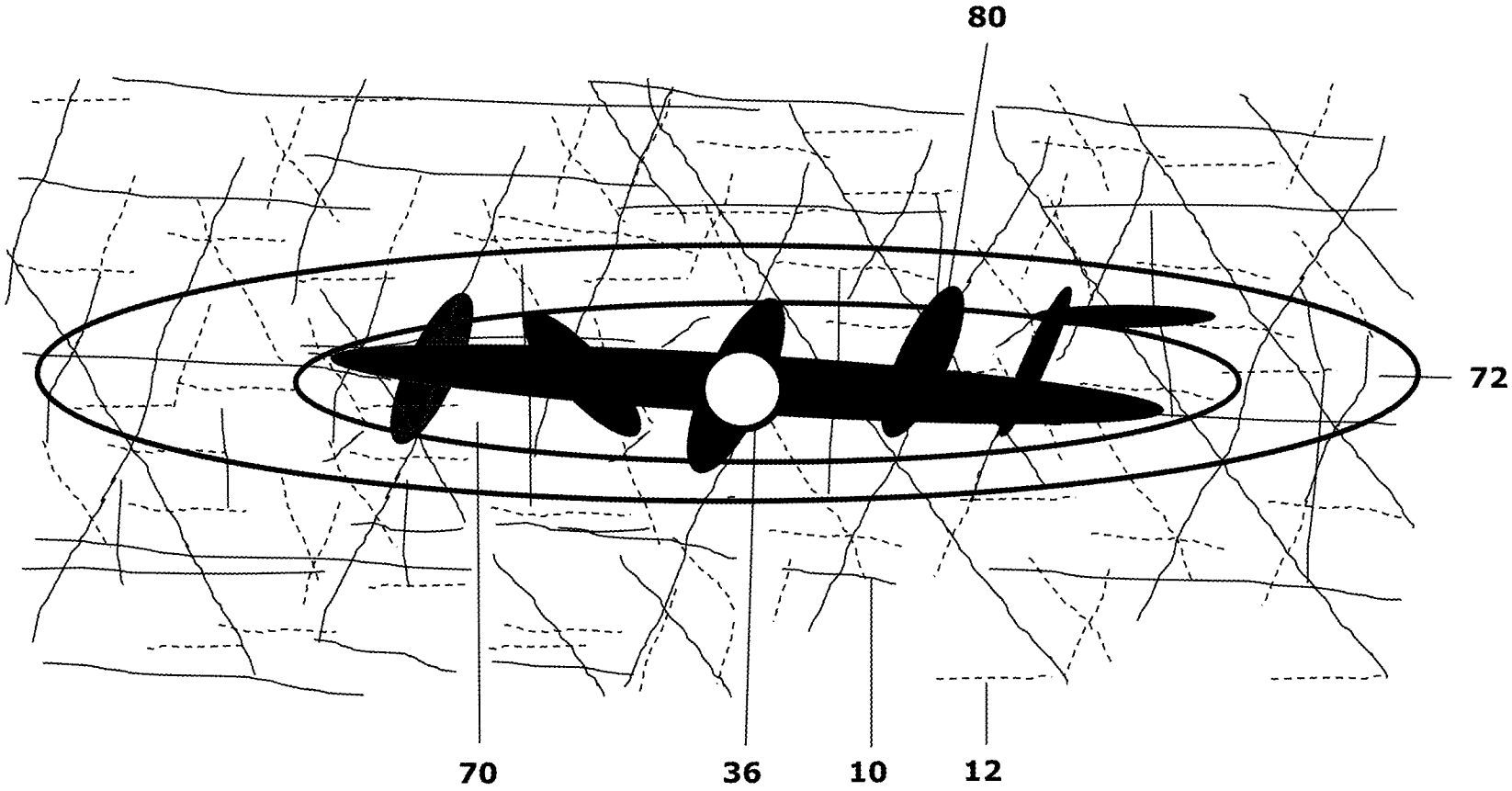

FIGS. 9A and 9B depict the results of a typical stimulation process using the present method. FIG. 9A depicts the results of the stimulation process after stage ii described herein, although it is understood that this drawing is not to scale. In practice, the dilated zone 38 extends far beyond zone 72 to thereby stimulate and access more formation. FIG. 9A depicts fractures emplaced and propped in different orientations, which is governed by the orientations and existence of the natural fracture system. In some directions the high injection pressures have parted the natural fractures 10 to become open natural fractures 69, and in different orientations shearing took place, as depicted in FIGS. 6, 7 and 8, giving rise to further fracture conductivity enhancement and proppant ingress. The larger the stress changes and the displacements, the more effective this process. Because in stage ii a fine-grained proppant is employed, the propped fractures may be viewed as relatively thin and long.

FIG. 9B depicts the same formation as FIG. 9A after completion of stage iii of the present method. Stage iii uses coarser-grained proppant which is more rapidly deposited than the stage ii proppant, in a process called proppant zone "packing". In this process, large distortions and displacements are generated on the surrounding rock mass including the volumes stimulated by stage i and ii injection processes, as per the mechanics described above in the present method.

This leads to more near-well ΔV and increasing Δσ', triggering concurrent wedging and shear dilation of natural fractures 10 to become open natural fractures 69, and opening and extension of incipient fractures 12. In FIG. 9B, proppant-packed fractures 80 are depicted to lie entirely within the volume of the stage ii proppant zone 72, and in fact these stage iii packed fractures may be induced fractures and/or the same natural fractures that were wedged and sheared to become open natural fractures 69 in previous stages. Only at this stage iii they are aggressively packed with proppant to generate a higher localized permeability region 70 around the wellbore 36, as well as induce the large distortions that lead to further shear and rock block rotation in the affected area 70, 72. In the present method, the injection procedures and the evaluations periodically carried out may be employed in an optimal manner, changing the methods and slurry concentrations (i.e. the amount of proppant mixed into the fracture fluid and/or the grain-size of the proppant, and the total cumulative volume of proppant injected during stage iii), to optimize the stimulation for the proppant and water volumes placed into a low-permeability formation.

Figure 10:
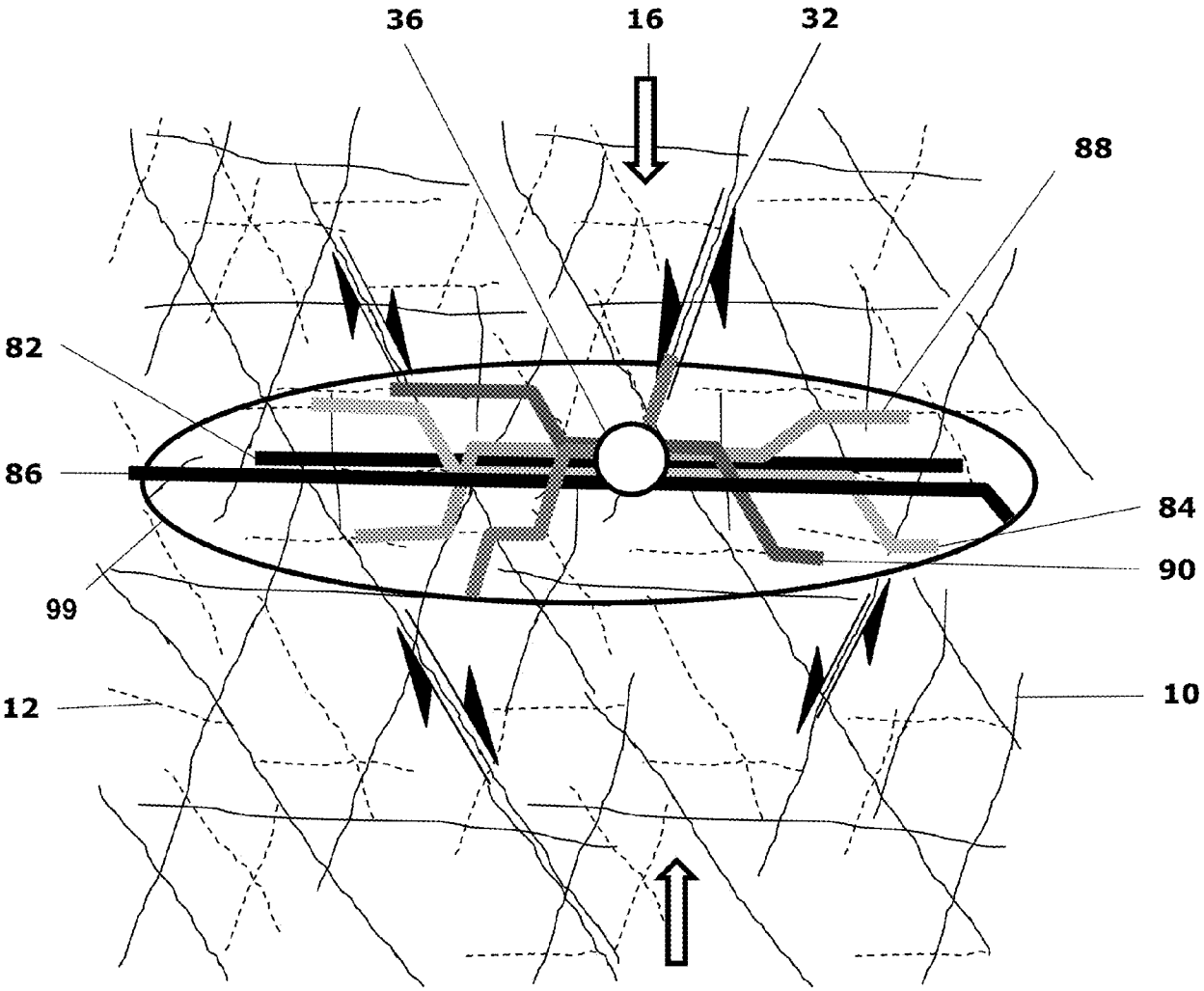
FIG. 10 is a further schematic view of a formation depicting the results of the present method.

FIG. 10 depicts how the present method described herein leads to progressive conductivity enhancement of the natural fractures system to because of the mechanics (described herein as per the present method) deliberately induced in the region of the stimulated rock volume zone 99 during all stages. An enhanced fracture 82 is followed in time by generation of a new orientation enhanced fracture 84, then followed by further new orientation enhanced fractures 86, 88, 90 as coarse-grained granular proppant is carried into the formation during stage iii. Each fracture plane increases the volume change and widens the apertures of the surrounding natural fracture network, and this in turn leads to further stress changes and higher pressure in the local formation; such that there are additional stresses generated and pore pressures increased along fractures that are suitably oriented, causing shearing, wedging and dilation of the rock mass surrounding the proppant-filled fracture zone. The different fracture orientations i.e., 82, 84, 86, 88, 90 are intended to depict that this process is not the generation of entirely new fracture planes within the rock mass, but a stimulation generated by inducing shear and/or dilation and block movements/rotations of the existing natural fractures 10 and incipient fractures 12 that are always found in stiff, low-permeability strata.

Figure 11:
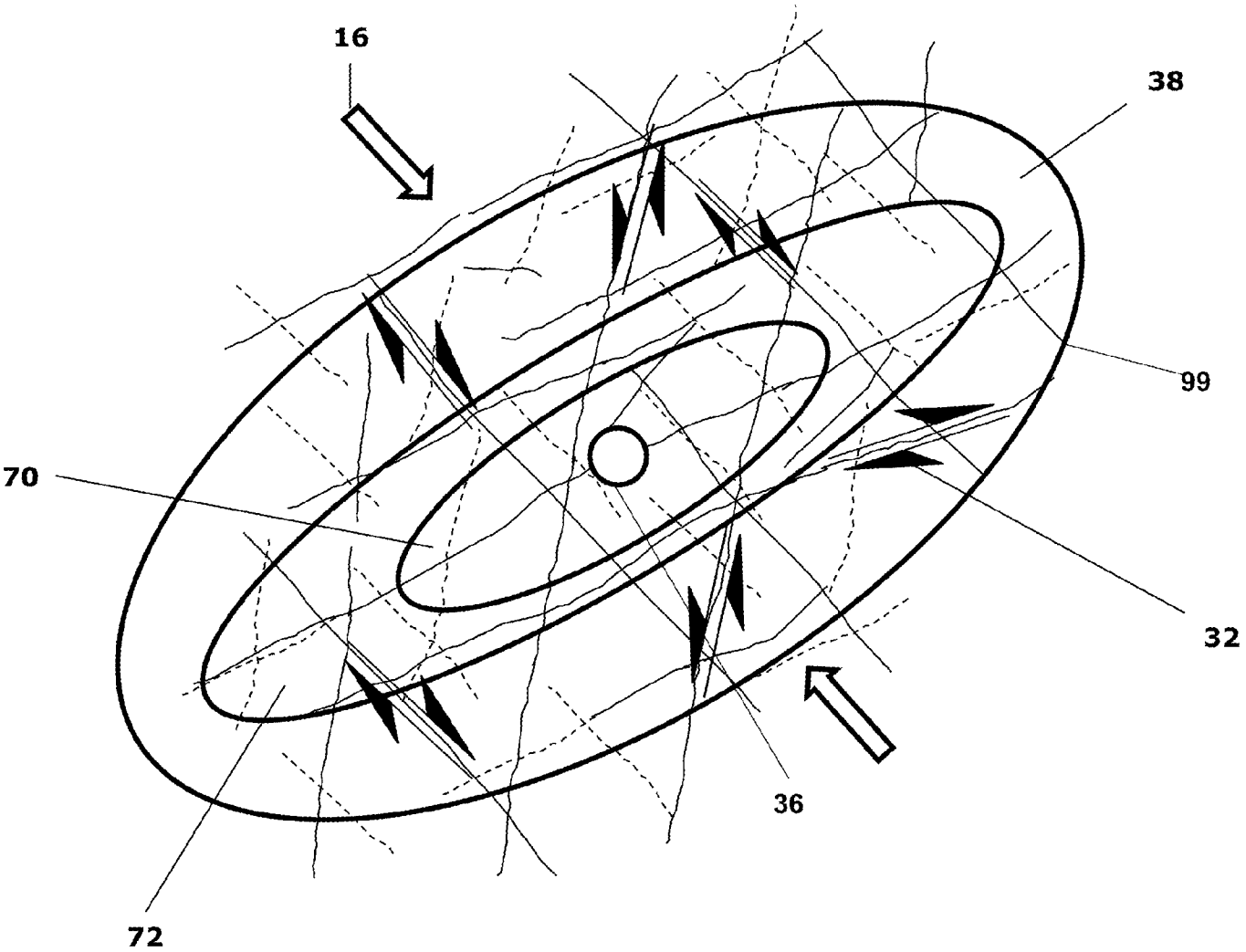
FIG. 11 is a further schematic view of a formation depicting the results of the present method.

FIG. 11 is a more general depiction following stage iii showing the dilated zone 38, the proppant zones of stage ii (72) and stage iii (70), and the shearing of appropriately oriented fracture planes in the surrounding rock mass, leading to a stimulated volume 99 comprising both the proppant and the dilated zone 38. Proppant injection into the proppant zones during stages ii and iii create a larger dilated zone 38 surrounding the sand zone as per the mechanics described herein. Although not depicted for clarity, the physical nature of the induced shearing and block movement/rotation processes following stage iii causes more natural fractures 10 to become open natural fractures, while other parts of the natural fracture system shear and dilate to become permanently self-propping. The open natural fractures do not close when Δp approaches zero, but are still sensitive to Δp during depletion of the resource from the formation. As described herein, the zones closest to the injection well are propped with proppants 70, 72 and the outermost zone is self-propped without proppant 38.

Figure 12:
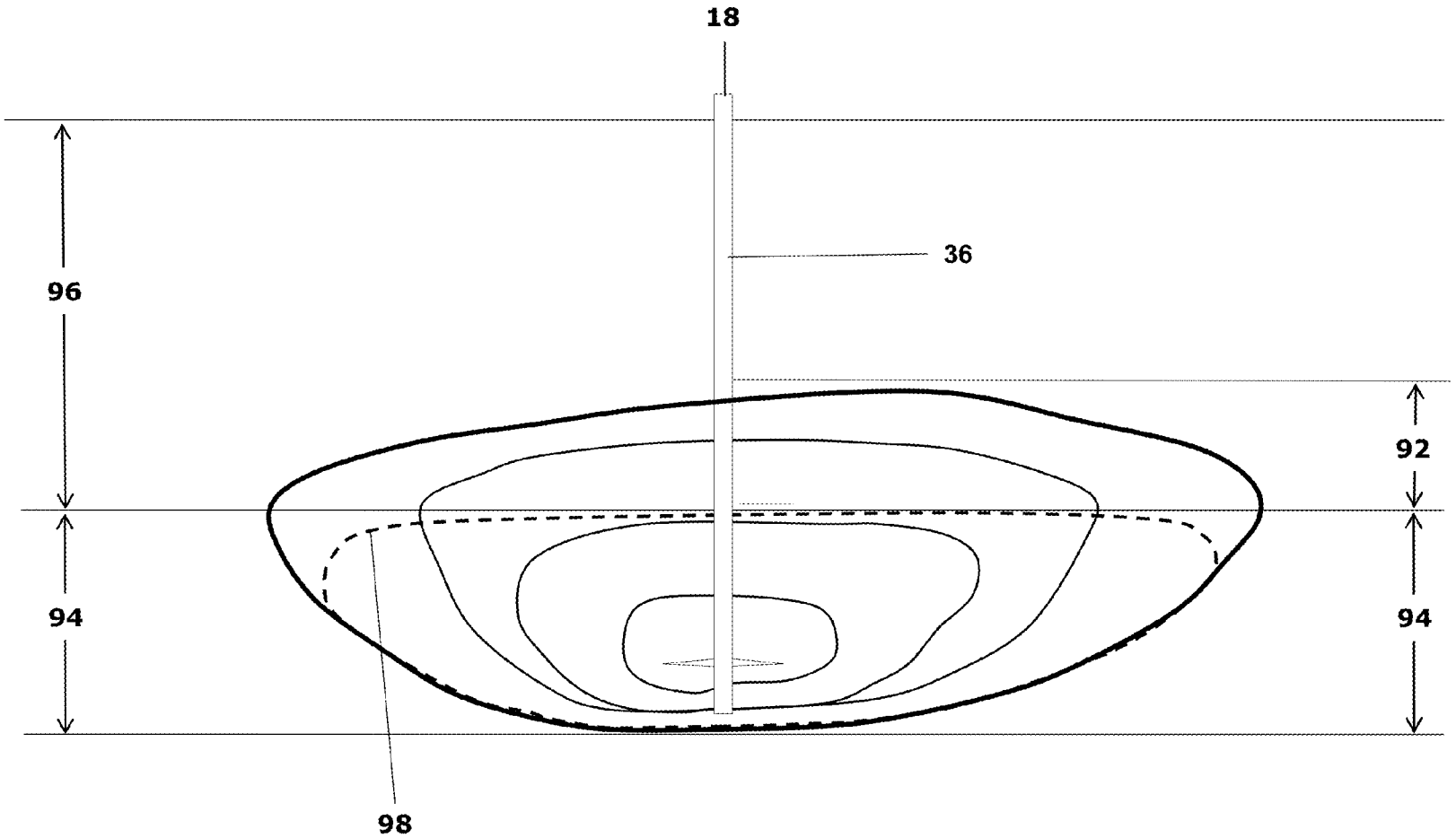
FIG. 12 is a further schematic view of a formation depicting the results of the present method showing progressive stimulated rock volume within the target zone of interest and out of the target zone.

FIG. 12 depicts the phenomenon known as fracture rise, which occurs because the density (and therefore the hydrostatic gradient) of the clear water used as the fracture liquid is less than the horizontal stress gradient in the rock mass. As a result, non-target zone fractures 92 may tend to rise out of the target zone 94 into the non-target zone 96. However, in the method described herein, the proppant carried in the clear liquid settles as the water rises 98, and this tends to prevent the proppant from rising into the non-target zone 96 where the presence of proppant has no desirability because of the lack of hydrocarbons. Accordingly, the proppant tends to stay within the target zone 94 being stimulated. It is one aspect of the present process that this tendency to avoid placing proppant too high in vertical directions can be controlled through the optimization of injection rate and pressure (i.e. increasing or decreasing these parameters to be slightly below or above the fracture extension rate/pressure during stages i and ii, as previously described), proppant concentration, optimizing slurry concentration, and the frequency and durations of the episodic (cyclic) nature of injection; thereby ensuring optimum distribution of the injected proppant and induced in situ volume change within the stimulated zone of interest, as is typical of the SFI process, in contrast to prior art. In this depiction, the presence of natural fractures 10 has been omitted merely for clarity.

Figure 13:
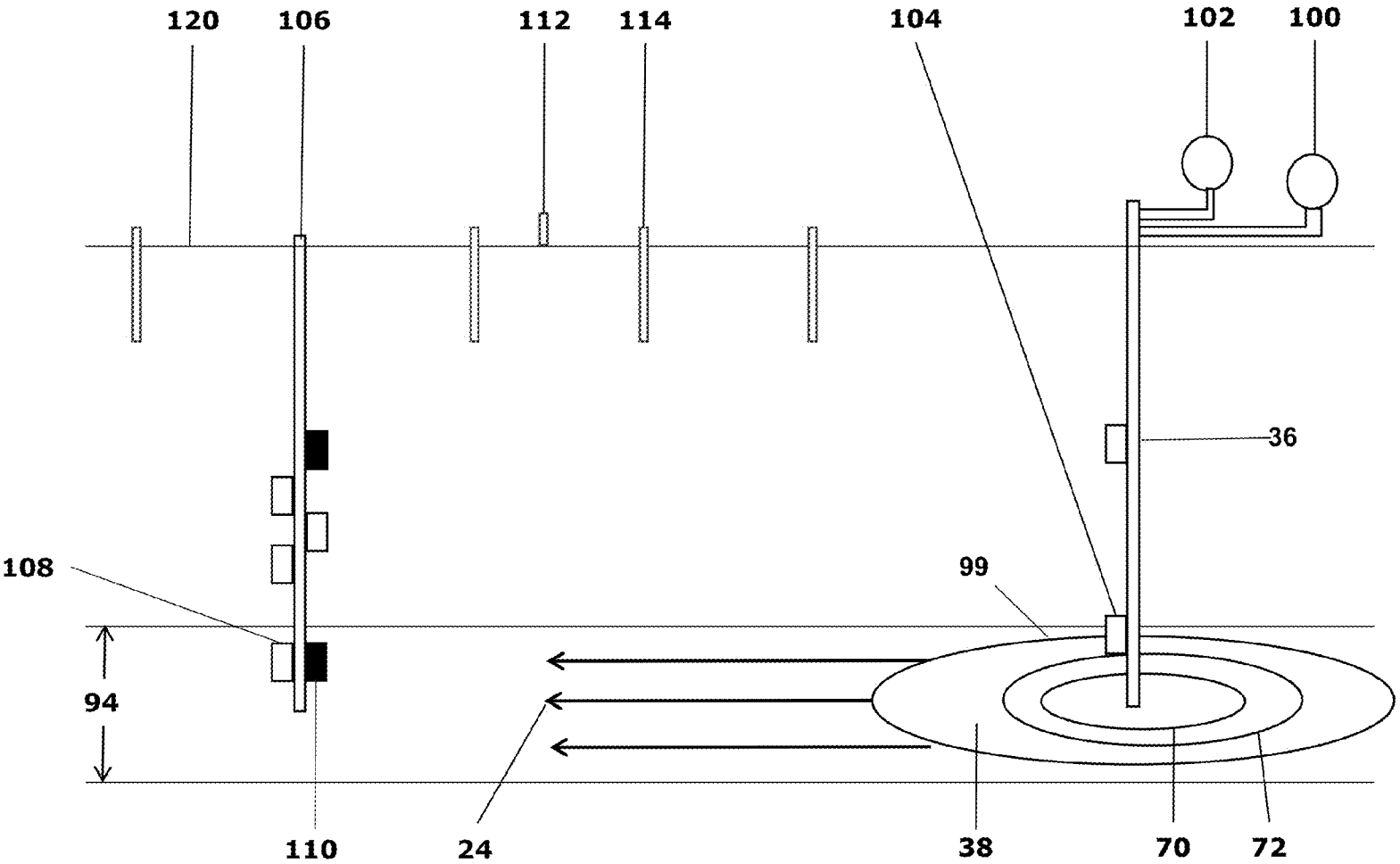
FIG. 13 is a schematic view of a formation depicting methods of gathering process monitoring data relevant to assessment of the formation response to an injection operation at a well.
Figure 14:
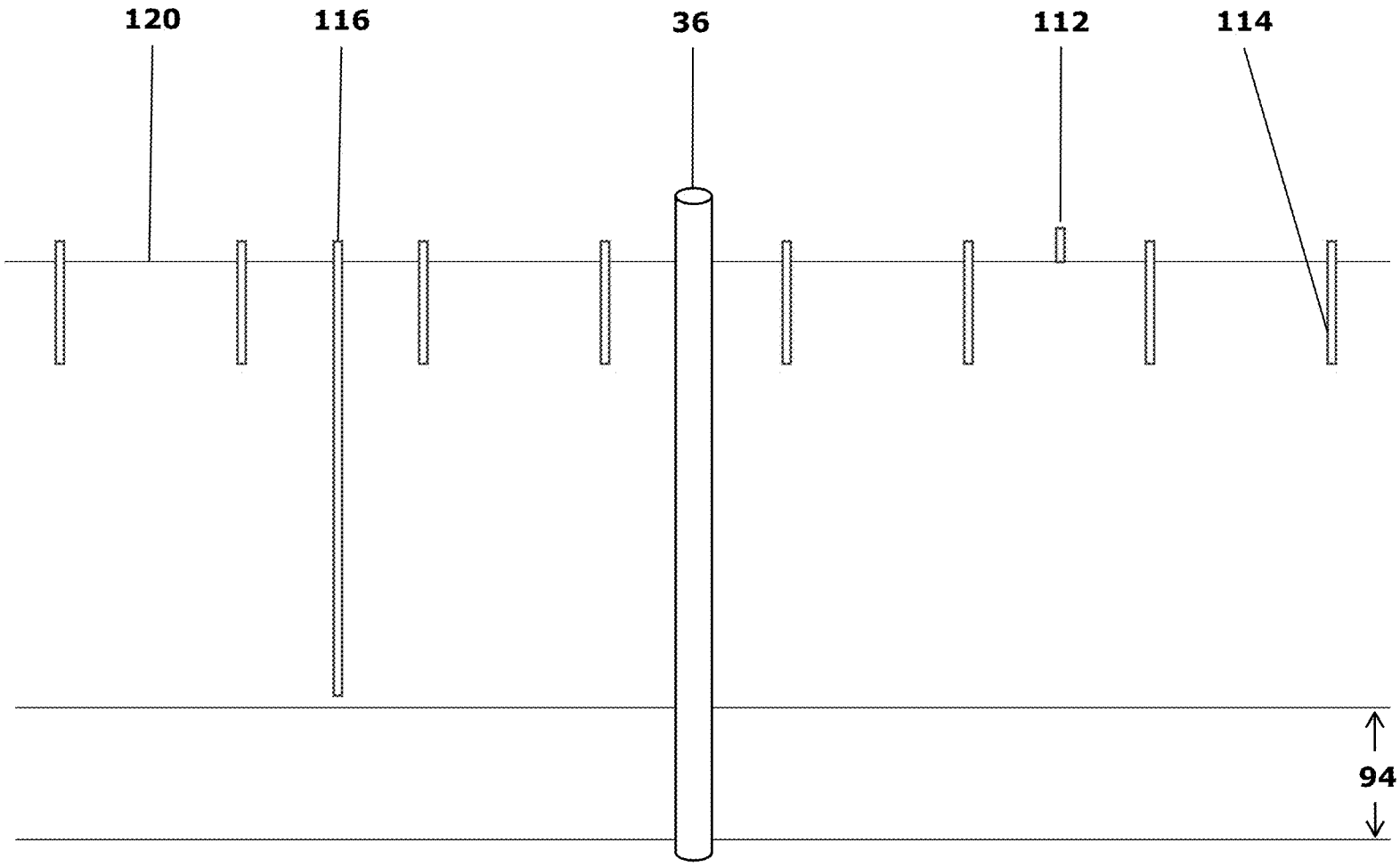
FIG. 14 is a further schematic view of a formation depicting methods of gathering of surface and subsurface deformation data relevant to assessment of the formation response to an injection operation at a well.

FIGS. 13 and 14 depict methods of gathering operational, wellbore, microseismic and surface deformation data (i.e. process monitoring) to help track the location and distribution of the enhanced fracture conductivity and volume changes in the rock mass that may be used in the process described herein. Process monitoring techniques combined with pressure and rate monitoring can be used to track the fracturing process while active injection is going on. As well, these monitoring techniques can be used to evaluate the nature of the altered zone, after various injection cycles and stages (i.e. formation response). This permits analyses of the size and nature of the stimulated volume zone 99, permitting design decisions and operational procedures for subsequent cycles or stages to be made. FIG. 13 depicts process monitoring of the formation response to injection operations in order to improve design and process control during all stages of the present method. During water and slurry injection, process monitoring also includes: wellbore logging, measuring bottom hole pressure 104 as well as wellhead pressure 102 and casing pressure 100, offset Δp monitoring wells 106, with geophones 108 and pressure gauges 110 in order to measure formation response in the target zone away from the injection well. FIG. 14 depicts a deformation measurement array including surface Δθ tiltmeters 112, shallow Δθ tiltmeters 114 and deep subsurface Δθ tiltmeters 116 as well as Δz surface surveys, satellite imagery and aerial photography of the surface 120 in order to measure formation response (in this case volume change ΔV) in the target zone 94.

The major technical objectives for monitoring the injection operations are as follows:

1. To evaluate injected material containment in the target formation 94.
2. To map out development of the stimulated rock volume caused by the methods described herein.
   - To correlate the monitoring data to determine the aerial and vertical distribution of the injected material and in situ volume change;
   - to determine the magnitude and distribution of formation shear movement and volumetric deformation response to the injection process.

3. To use analyses of monitoring data and formation test data to assess the stress changes and fluid flow changes occurring the target zone caused by the methods described herein.
   - such formation test data can be derived from (but not limited to) minifrac tests, stage rate tests, and PFOT; to assess formation stress state changes and fluid flow system changes during injection operations to develop the stimulated rock volume 99.
   - monitoring data is used for evaluation of the effect of the stages and numerous injection cycles to increase the efficacy of the fracturing process to enhance the fluid conductivity in the fracture through the mechanics described herein (shear dilation, fracture opening, rigid block movements), and through the through alteration of these processes during the active fracturing operations and between injection cycles, based on analyses of the collected information and subsequent alteration of the injection process (injection strategy).
4. Optimize the conductivity enhancement of the fracture system by implementing changes in the injection strategy, as determined to be necessary by the analyses of the monitoring data and formation test data (i.e. based on analyses of the collected information).

Figure 15A:
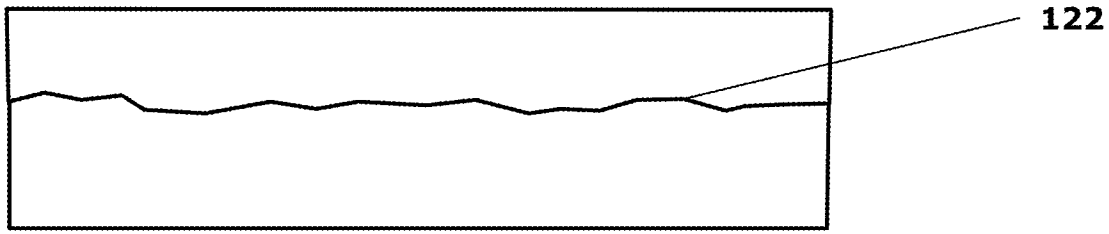
FIGS. 15A-C are schematic views of a formation depicting a natural fracture therein with shearing acting on the fracture, and showing the shelf propping effect and fracture conductivity enhancement; and extension of this effect to incipient fractures.
Figure 15B:
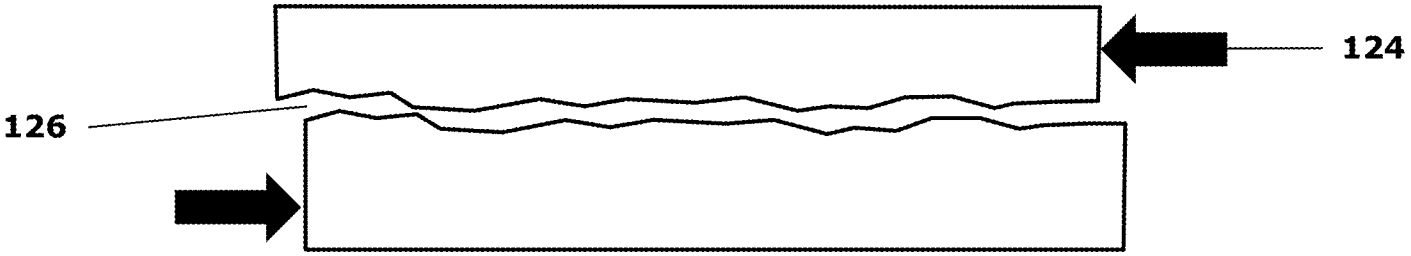
Figure 15C:
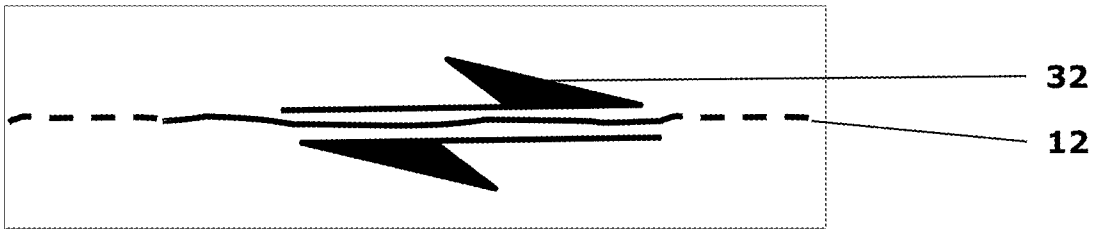

FIG. 15A is a depiction of a cross-section of an individual naturally existing fracture plane 122 that is closed, similar to the myriad of fractures shown in FIGS. 1 (10 and 12). FIG. 15B is a depiction of shear displacement 124, whereby shear stress/displacement propagates the fracture, incipient fractures open and mismatch occurs between the fracture faces due to the differential stress state; that leads to a permanently dilated and flow enhanced fracture 126. This is a depiction of the processes that occur during shear 32 of natural fractures 10 shown in FIGS. 6, 7, 8 10 and 11. FIG. 15C depicts extension/propagation of an enhanced fracture so that an incipient fracture 12 is also subjected to shearing, thereby experiencing displacement and dilation, leading to further conductivity enhancement of the fracture system and a large increase in permeability. A goal of the present process, of relatively lower fracture injection rates, longer-term injection, and multi-stage and cyclic episodes of fracturing, with evaluation of the effect of the stages and numerous injection cycles is to increase the efficacy of the fracturing process to enhance the fluid conductivity in the natural fracture through the mechanics described herein (shear dilation, fracture opening, rigid block movements). And through the through alteration of these processes during the active fracturing operations and between injection cycles, based on analyses of the collected process monitoring information and subsequent alteration of the injection process (injection strategy).

The alteration of the injection strategy process can be through increasing or decreasing the injection rate and pressure parameters (as previously described), changing the proppant slurry concentration (as previously described), changing the frequency and durations of the injection stages, and changing the frequency and durations of the overall injection cycles. Such alterations of the injection process can occur at any of the stages of injection of the method described herein, either severally or jointly. This type of alteration (flexibility) of the injection strategy that is an integral part of the process described herein differs from conventional fracturing techniques (even when such conventional fracturing employ different pads employing different injected fluids).

Figure 16A:
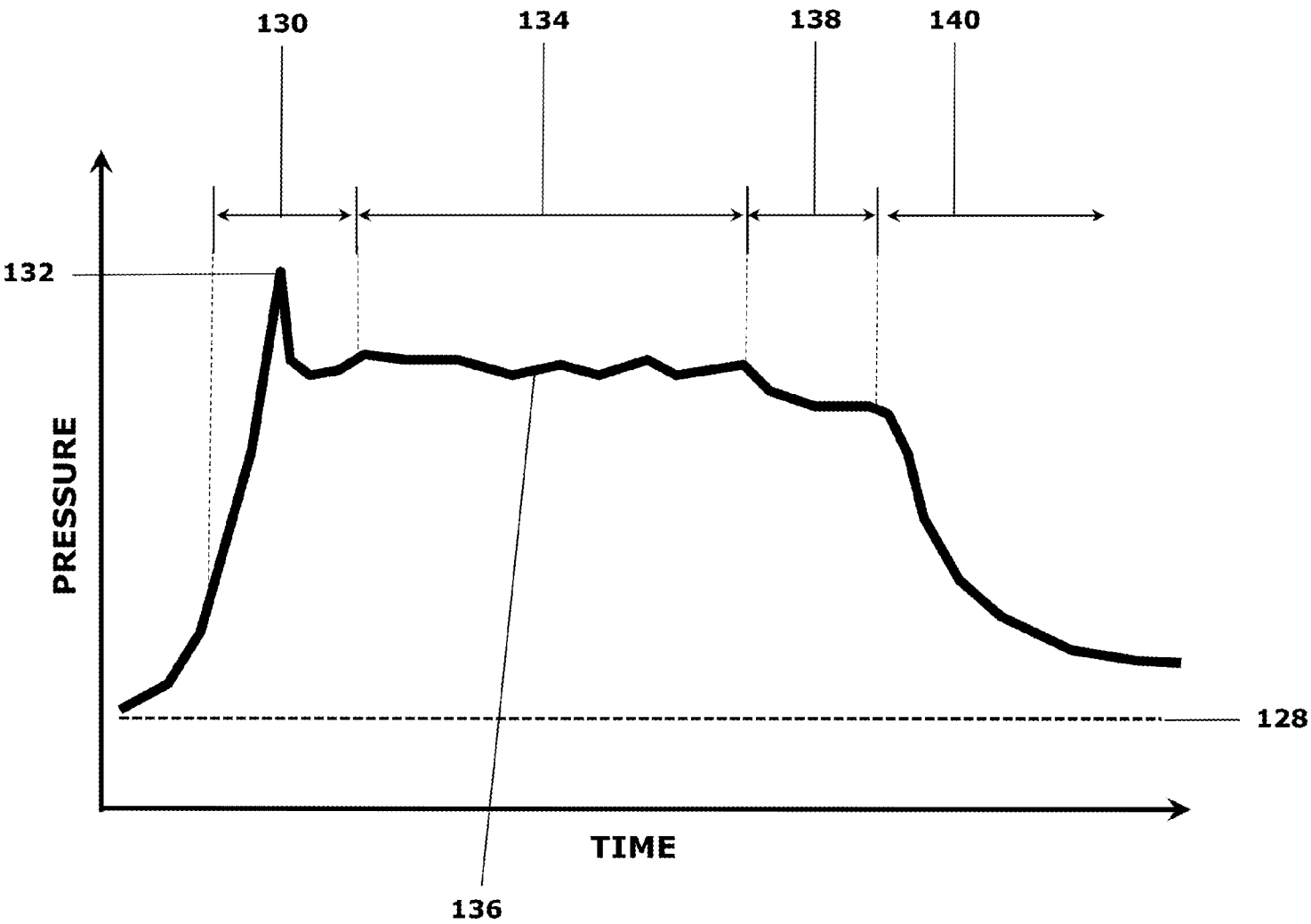
FIGS. 16A and B are graphs depicting the application of multiple cycles of the injection stages of the method described herein.
Figure 16B:
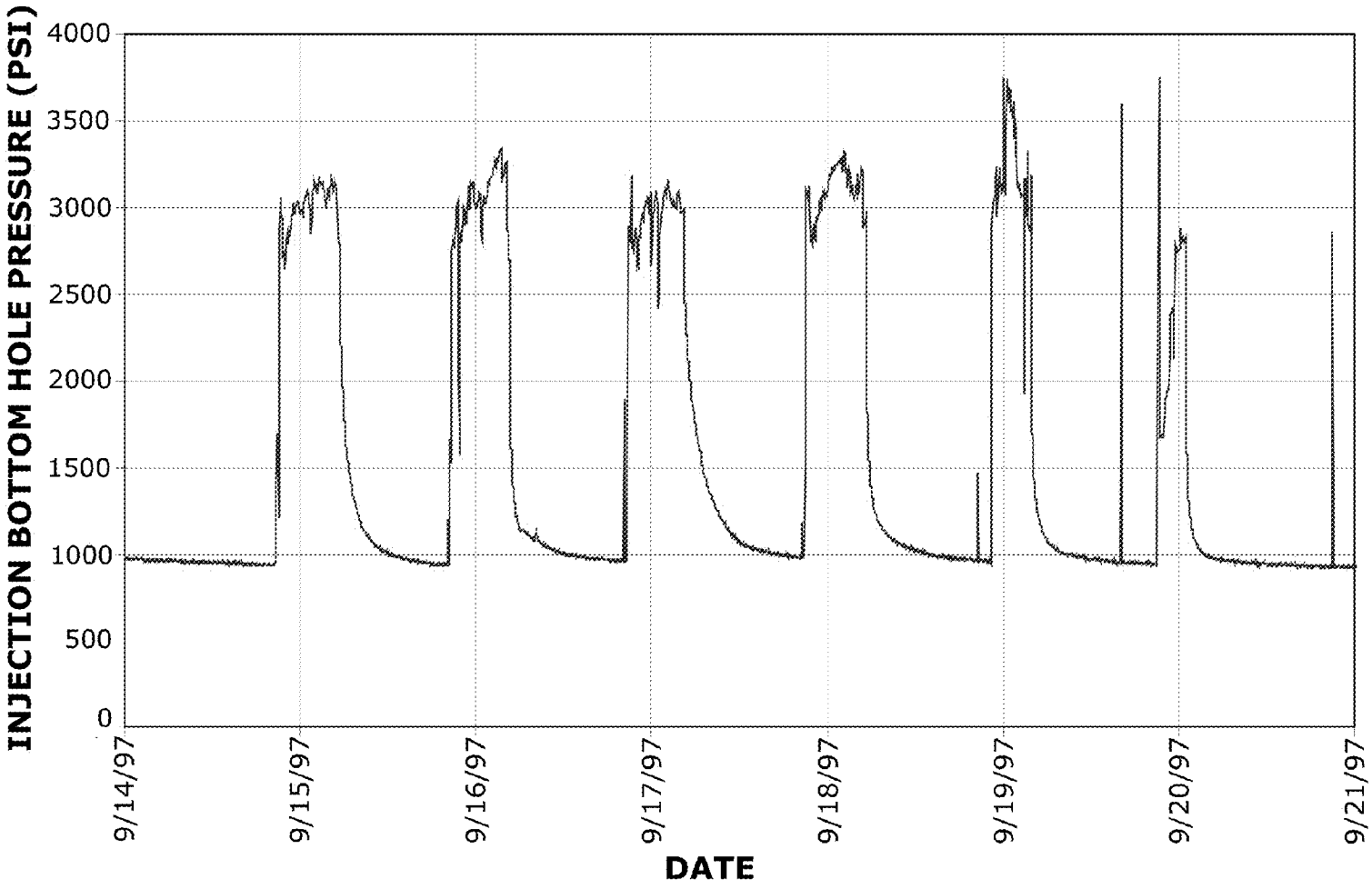

FIGS. 16A and B are graphs depicting the application of multiple cycles of the injection stages of the method described herein and bottomhole pressure data collected during granular proppant injection into high permeability sandstones for purposes of waste disposal. FIG. 16A depicts the daily cycle of the SFI™ process that increases pressure above the minimum formation fracturing pressure 128 including the water injection phase 130, the injection start-up 132, the granular proppant injection phase 134 leading to propagation pressure 136, a further water injection phase 138 and a pressure decay period 140. FIG. 16B depicts multiple day cycles which confirms that long-term SFI™ injection of proppant-water slurry may be sustained. The SFI™ process may be sustained, but is not limited to, over a period of months. FIGS. 16A and B depict the method described herein being capable of fracture re-initiation, cessation, re-starting, and so on, during the course of a prolonged stimulation process involving many days and many cycles. The method described herein can include the steps of ceasing injection occasionally to evaluate the progress of the process, and changing the design and the nature of the operation for subsequent cycles and stages as required to reach an economical and efficient stimulation of the region around the wellbore 36 in a low-permeability stiff rock mass containing a myriad of natural fractures 10.

Figure 17:
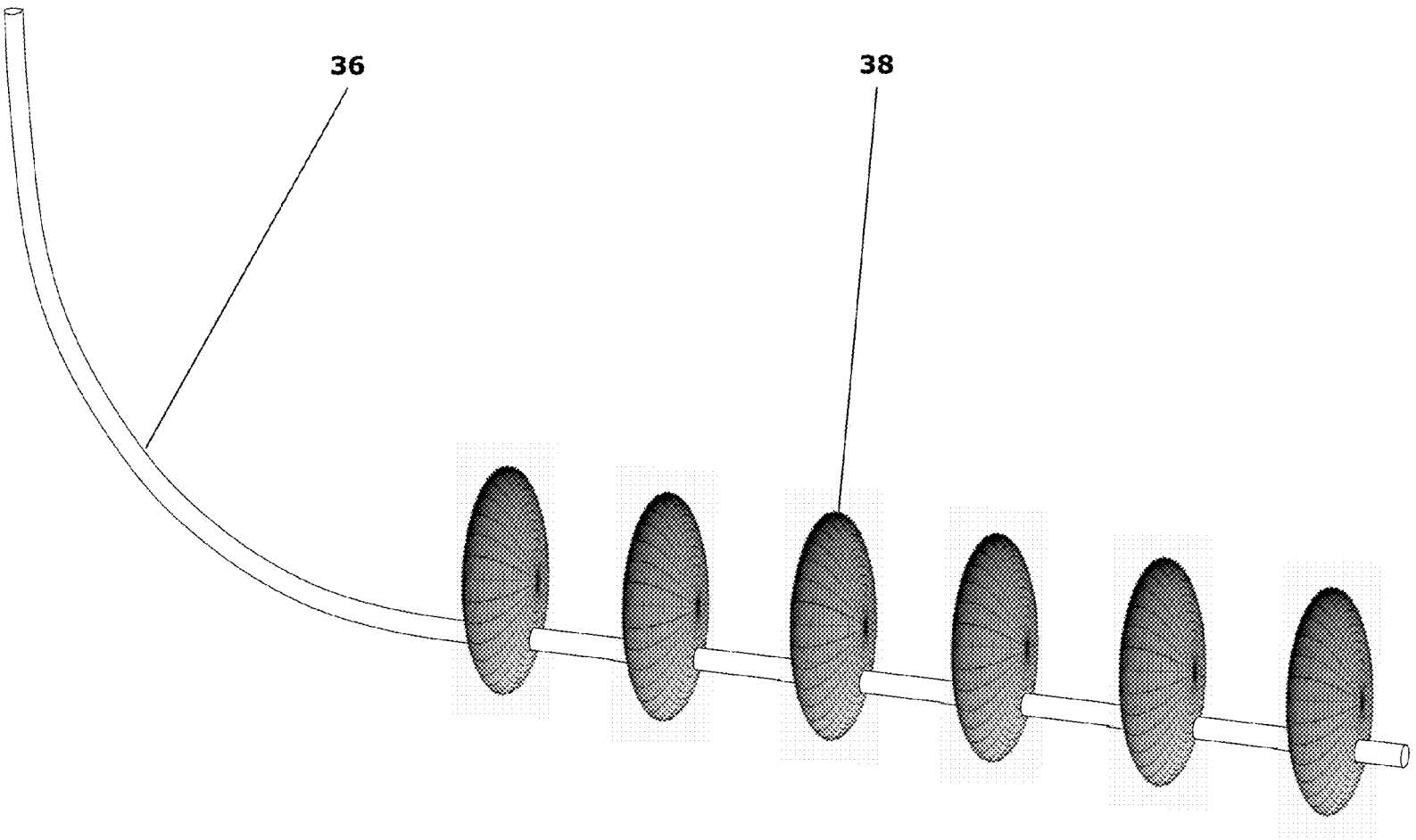
FIG. 17 is a schematic view of a formation depicting stimulated regions within the formation distributed along a wellbore.

FIG. 17 is a depiction of a plurality of stimulated regions 38 within a target zone formation 94 distributed along a wellbore 36, wherein the naturally-occurring fracture network has been enhanced, expanded and enlarged by application of the process and methods described herein.

The present method may be practised in a geographic region in which an oil or gas-bearing shale formation exists in a relatively deeply buried state. The present method entails the generation of a fluid conductivity enhanced network of relatively small fractures occurring naturally within the formation, and the opening and extension of incipient natural fractures into the dilated zone 38; combined with and surrounding an induced secondary fracture network propped with proppant 70 and 72 (FIG. 11). The present method may be contrasted with prior art processes involving massive large scale artificially induced fracturing of the formation. The present method may utilize the natural fracture 10 network within the formation and a series of induced fluid flow alteration and formation deformation mechanisms (not present in the prior art processes) as elements in developing an extensive conductive fracture network for the production of hydrocarbons; and these elements can be stimulated to an efficient state through implementation of a number of stages and cycles that are designed, implemented, and altered based on the results of a number of measurements to assess formation response to the injection operations, such as the PFOT, SRT, deformation and microseismic emissions field.

Preliminary Assessment of Formation

Prior to commencing the injection stages at a specific perforated site 25 along the wellbore 36, the minimum fracture pressure and/or rate of the formation is determined. For this purpose, a step rate test (SRT) assessment may be performed. This procedure entails commencing injection of clear water, without additives or particulate matter, at a low but constant injection rate while measuring the formation pressure response to the water being injected. The initial value of the injection rate is typically on the order of 0.25 to 1.0 bpm, and typically a time period of from 5 minutes to 30 minutes is permitted to allow the injection pressures to approximately achieve a constant value. Then, without ceasing the injection process or altering any other conditions, the injection rate is increased by the same amount, on the order of 0.25-1.0 bpm, and the formation pressure is once again allowed to equilibrate. This 'stepping up' of the injection rate is repeated several times to a predetermined maximum injection rate.

The injection rate and the corresponding injection pressures are plotted on a graph in such a manner as to permit the operator to determine at which injection rate and pressure a substantial hydraulic fracture was generated at the injection location. This information is also used to assess the value of the minimum fracturing pressure and rate of the formation (known as the 'minimum fracture extension pressure' and the 'minimum fracture extension rate'), and is hence used in the determining the injection pressures and rates of the subsequent hydraulic fracturing process stages.

The determination of the minimum fracture pressure and/or rate may be repeated during the hydraulic fracture stimulation process described below in order to evaluate stress changes and injectivity changes in the target formation and thereby gather more data that can help to alter the injection strategy to achieve optimum results by altering the injection pressures and rates to maintain these at or near the optimum fracture injection rate and pressure needed to develop, maintain, and propagate the in situ mechanisms described herein (i.e. shearing, wedging, block rotations). If these values change, then the injection pressures and rates during the stages described below can be adjusted to maintain these at the selected level relative to the minimum fracture values of the formation.

According to one embodiment, following the above determination, one or more of the completed injection well perforated sites 25 is isolated from the rest of the well and then is fed first with pressurized water and later with a water and proppant slurry for inducing fracturing within the shale, using the present method as described herein As will be described below, the water or water and proppant slurry is fed into the injection well 36 in a predetermined sequential fashion. The source or sources of slurry may comprise any suitable mechanical system capable of generating a pressurized aqueous slurry with sand or other particulate matter as a fracture proppant and suitable additives on demand and for selected periods. Any suitable source of water may be used for injection or to mix with proppant and additives to make a slurry, including surface water, sea water, or water that was previously produced along with oil or natural gas, on the condition that the water is free of minerals or particles that could impair the ability of the shale to produce the hydrocarbons present in the natural fractures 10 and pore space. If deemed necessary by geochemical analysis or other studies, such water may be treated chemically so as to avoid any deleterious reactions with the natural water and minerals in the formation to be stimulated.

Stage i—Enhancement of the Natural Fracture System

Stage i generates an initial conductivity enhancement of the natural fracture network, termed herein a "stage i fracture network" 38. This network comprises essentially natural fractures that have been enhanced to form permanent high permeability paths connecting to the injection well within the formation. In one embodiment, this step comprises injecting a non-slurry solution into a well extending into the formation at an injection rate which is slightly above or below the minimum hydraulic fracture extension pressure and rate of said formation (as determined from a minifrac test and/or SRT). In some embodiments, the injection rates and pressures are up to 8%, 5% or 3% above the minimum fracture pressure and rate. In other embodiments, the injection pressure and rate are at or slightly below this level. In some embodiments, these levels may be in the ranges of 0-8%, 0-5% or 0-3% below the minimum hydraulic fracture extension pressure and rate formation values. It is contemplated that variants of this range may be adapted for use in any low permeability rock type to achieve the described mechanics of the present method.

The stage i fracture network consists essentially of enhanced native fractures and incipient fractures that have been dilated by aperture opening and shear displacement with shear dilation 32, which occurs between naturally irregular fracture surfaces. The stage i fracture network comprises unpropped fractures that are permeable to fluids such as oil, gas and water.

Stage i comprises cyclic or non-cyclic injection with relatively longer injection times and lower injection rates/pressures compared to prior art fracturing processes for water-generated hydraulic fracture stimulation of the target formation at and around the selected perforated site 25 of a wellbore 36. In one embodiment, the injected water also contains no additives other than optional saline. It thereby has the effect of increasing the pore pressure within the formation and thus extending enhanced hydraulic fracturing stimulation effects on the native fractures 10 and incipient fractures 12 as far out as possible into the formation 38 from the perforated site 25. This increase in pore pressure in the formation that is also acted upon by the naturally existing stresses in the earth triggers an increase in both the natural fracture aperture width and a shear dilation effect that leads to self-propping (FIGS. 6, 7 and 15).

The injection parameters of stage i can be based on the magnitude of deviating stress state within the formation, namely the stresses that tend to urge slippage along incipient fracture planes (FIGS. 6,7). For example, a formation that is under a highly deviating stress regime will tend to generate a relatively large shearing action 32 when the fracture is slightly dilated, thereby opening a fracture for enhanced fluid flow as per the mechanisms described in the present method. By way of example, the minimum hydraulic fracture extension pressure may be determined to be about 4500 psi at a rate of 3 bbl/minute, and the stage i injection may be performed within the range of 4200 to 4700 psi injection pressure with an injection rate of 2.6 to 4 bbls/minute.

Under continued injection, this process of opening the natural fractures will propagate from the well outwardly into the formation. The long term water injection step interacts with natural fracture 10 system in a number of ways. First, it acts to hydraulically connect a myriad of natural fractures 10 together i.e., establish hydraulic communication between the fractures 10, creating an interconnected pathway network 38 to the injection well 36. Second, the high pressure acts to open natural fractures 10 and incipient fractures 12 as the rock mass seeks to accommodate itself to the influx of large fluid volume during injection and the changes in the effective stresses; and part of the opening of these natural fractures 10 and incipient fractures 12 is permanent in nature, leading to permanent high permeability paths connecting to the injection well 36. Third, as depicted in FIGS. 6A and 7A it is also indicated that appropriately oriented natural fractures 10 will undergo shear displacement 32 under conditions of higher pore pressures and deviatoric stress state due to injection of the water into the formation.

The increased pore pressure and changing effective stress state facilitate the opening and shear displacement of the natural fractures 10 to form open natural fractures 69, as depicted in FIGS. 6, 7, 8, 10 and 11, so that the opposing surfaces no longer close fully or match perfectly upon closure, leaving a remnant high permeability channel because of the shear displacement and dilation, as depicted in FIG. 15. This latter process of shear displacement and permanent dilation of the natural fracture 10 network is referred to as self-propping, and it leaves a remnant network 38 of high permeability channels interconnected with the hydraulically induced fracture network 70, 72 (FIGS. 9, 10) that facilitate the flow of oil and gas to the production wellbore. It is part of the present method to continue to inject clear water aggressively so that the process propagates outward from the injection point and creates a large volume of interconnected and opened natural fractures 69 that form an extensive drainage area 38 around the injection point through the mechanisms described herein.

In some cases such as when the target formation consists of swelling shale or other geochemically sensitive rock, brine or other salt solution can be used to inhibit swelling. In general, the use of gels and other agents should be avoided or minimized, since most such agents are viscous and deposit a residue within the formation and reduce the natural permeability of the rock, or partially block the flow paths of the induced and stimulated fracture network, or lead to elevated stress conditions along the fractures; all of which will inhibit the fracture conductivity enhancing mechanisms as described herein. Caution is exercised so as to ensure that the injected fluid is compatible with the target formation rock. For example, saline solutions can potentially affect the wettability of the rock. As well, if this solution is too acidic, this may tend to make the rock more oil wet, whereas if the solution is salt-free and too basic high pH, it can facilitate the swelling of clay minerals in the shale that are susceptible to chemical effects. It is contemplated that the injection liquid will consist of any liquid varying from fresh water to saturated sodium chloride brine with a pH controlled value of about 6.0 to 7.0, or approximately of neutral acid/base nature. Although it is contemplated that variants of the composition of this injected fluid may be adapted for use in any low permeability rock type to achieve the described mechanics of the present method.

Stage i is performed until generally no further self-propping fractures are generated by continued injection of the non-slurry solution at the selected pressure and rate of stage i. The specific time length of the water fracturing of stage i is variable depending on the characteristics of the natural fracture 10, 12 network and their response to the injection process. Stage i consists of a single or several prolonged injection episodes (cyclic injection). Their duration and characteristics, such as injection rate, pressure, time period, shut-in period, flowback period, and in some cases additives introduced into the injection fluid, may be determined with various types of formation testing (SRT, PFOT), deformation measurements, microseismic emission measurements, or a combination of these methods; all used to optimize the fluid conductivity enhancement of the natural fracture system and the extent of the stimulated rock volume zone 99. Specifically, the stage i process involving water injection can be continued, optionally using a number of cycles of varying lengths, until the process has closely attained the maximum possible stimulated volume 38 around the injection location. In the use of deformation data, high precision inclinometers i.e., 112, 114 or other appropriate devices can be used to measure the deformation of the rocks and the surface of the earth. This indicates that the initial enhanced fracture network generated at this stage is at its maximal extent and further stimulation can only be achieved by introducing the stage ii fracturing conditions.

The amount of volume increase and its spatial distribution 38, 99 are mathematically analyzed as injection continues, allowing a determination to be made as to when the injection can be ceased. For example, when the deformation data show that there is no longer a significant increase in the volume of rock that is undergoing dilation around the injection site, one may cease performing stage i.

Similarly, microseismic emissions may be studied in a similar manner; the number, location, nature and amplitude of the emissions, each of which represents a shearing event around the injection location, are mapped and studied as the injection continues. Because each shearing event detected through the use of microseismic monitoring is associated with a shear displacement episode, active monitoring and mapping of these events is akin to mapping the propagation and extent of the zone where shearing and self-propping are occurring. For example, once the outward propagation rate of microseismic events slows down sufficiently so that it is apparent that further injection can have at best a marginal benefit on the volume of the stimulated zone, one may cease injection.

The duration of stage i may also be determined from formation testing to assess the change/improved permeability in the formation. Such testing may include Step Rate Tests (SRT) and Injection-Pressure Fall-Off Tests (PFOT). The SRT will provide a indication of the pressure/rate relationship (injectivity) in the formation and PFOT will provide an assessment of the fluid permeability in the formation and extent of this permeability enhancement. Such tests are conducted in a manner known by persons skilled in performing such tests.

Once injection during stage i has ceased, or if it is desired to perform an evaluation of the injected zone during the progress of the stage i water injection, the effect of the stimulation of the injection zone can be evaluated. This can be performed by measuring the rate of pressure decay 140 without allowing water flowback PFOT, or by the change of rate and volume of flowback if the well is allowed to flow, or by the use of specific pressurization or injection tests such as a SRT carried out to specifically assess the extent and nature of the region around the wellbore 36 that has been affected by the stage i injection process. If the well test results described in the previous sentence and preceding paragraph indicate that further benefit could be achieved through continuing injection, the stage i water injection is re-initiated and continued until there is a reasonable certainty that a stimulation close to the maximum achievable has been attained for the conditions at the site.

In some cases, a suitable duration for stage i is between 4 and 72 hours. Stage 1 may consist of a single injection cycle or a number of similar cycles. Furthermore, one or more non-slurry injection stages having the same procedures as stage i may be performed following a subsequent stage in the multi-stage hydraulic fracture cycling process, as described below. It is also contemplated that variants of the Stage i procedure may be altered for use in subsequent injection stages to achieve the described mechanics of the present method.

Optionally, at the end of the stage i injection(s), the well can be shut in for approximately a 12-24 hour period to measure the decay rate at the bottom hole pressure and conduct a PFOT. This PFOT assesses the pressure transient behaviour of the shut-in well and will provide a quantitative assessment of the enhancement of the natural fracture system in terms of permeability, fracture conductivity or transmissivity change, radius or volume of change, and the development or improvements of the fluid flow behaviour around the injection location; in terms of the fluid flow components such as linear flow, bilinear flow, radial flow, boundary condition effects, etc. This formation response information can be used to refine and improve on the stage i injection strategy (as described herein), as well as to aid in designing and implementing the injection characteristics for the proppant slurry for stage ii.

An alternative to the pressure fall-off measurements for evaluation of the volume and nature of the stimulated zone after the stage i injection, is to allow the well to flow-back under a constant stipulated back pressure. The rate of water flow is measured over time until flow-back has almost ceased, then the back pressure in the well is increased or decreased followed by a renewed flow-back, and the renewed flow-back is monitored carefully. The process is repeated and the results analyzed. Another alternative approach to evaluating the effect of the stage i stimulation is to execute one or more of a variety of injection tests and pressurization-decay tests SRT, PFOT or modifications thereto that are described in prior art; and the formation may also be monitored at the same time for deformation and for microseismic emissions.

Stage ii—Propping of the Stage i Fracture System

Stage ii may be commenced immediately or shortly after the conclusion of the final part of stage i, or without any substantial break in the injection process if so decided by previous analysis and evaluation, but usually after an extended PFOT. Stage ii comprises the injection of slurry comprising water and a relatively fine-grained proppant, for example a 100-mesh quartz and proppant. A suitable particle range for the fine-grained particulate material is from 50 to 250 microns (0.002 to 0.01 inches) in grain diameter. The injection rate and pressure during stage ii is higher than in Stage i and should exceed the minimum fracture extension rate/pressure of the formation; the injection rate can vary widely depending on equipment, depth, stress and other factors, but is generally in the range of 3-8 bpm.

The objective of stage ii is to introduce fine-grained sand or other particles (proppant) and have the proppant move into the formation, so as to prop open the increased apertures generated in stage i through partially filling the apertures of enhanced and opened natural fractures 69 with the particulate matter. In one aspect, the concentration of proppant is relatively low. In some embodiments, the concentration of proppant in the slurry is less than 10%, 8%, 6% or 4% by volume. It is also contemplated that variants of the composition of this slurry may be adapted for use in any low permeability rock type to achieve the described mechanics of the present method. In one embodiment, stage ii stabilizes and makes permanent ('crystallizes') at least some of the enhanced fractures located within zone 38 that were generated in stage i. However, stage ii does not significantly reduce the enhanced hydraulic conductivity generated in stage i within this zone by over-packing the fracture network with proppant. Stage ii thus creates an effected area 72 that is contained within the area 38, seen in FIG. 9A. The effects at the leading proppant tips 78 generated in stage ii are depicted in FIG. 8C.

Stage ii generates a further effect, namely by providing a flow path that can be used for further extension of the self-propping enhanced fracture network generated during subsequent stage i injection events. Additionally, when stage ii is performed as described herein, the proppant within the slurry is disbursed far out into the formation 72 to prop open and crystalize the enhanced fracture apertures within zone 38 generated in stage i. This has the effect of initiating the mechanics of wedging and block rotations (as described in the present method, and as shown in FIGS. 8B and 8C) in the formation which further enhances and can extend the zone of self-propping fractures 38 as seen in FIGS. 8A, 9A and 11. In one embodiment, use of the slurry having a low proppant concentration as described above enhances fracture opening within zone 38 by fracture and block rotation effects and wedging effects as shown in FIG. 8C. This occurs through similar processes as in stage i, namely shearing and/or dilation of the native fractures and incipient fractures located in zone 38. The proppant is restricted to zone 72 whereby the surrounding zone 38 consists essentially of self-propping fractures in communication with the fractures in zone 72.

Stage ii may comprise multiple cycles consisting of discrete proppant injection episodes, optionally of different concentrations, each of which is followed by a PFOT, preferably for at least 10-12 hours but as much as 20 hours or more, prior to commencing the next proppant injection episode. The PFOT results are analyzed mathematically to assess the stimulation effect on the fluid-flow system in the formation and to help decide the proppant concentration and injection rate and time length for the next cycle. Typically, once injection of water with a particulate propping material is commenced, one should not allow (or mitigate) fluid flow-back into the injection well 36 as this may plug the well. For each of the fall-off periods the pressure data for the wellbore 36 is collected to a sufficient precision so that the operations personnel may analyze the pressure change with time $\Delta p/\Delta t$ in a consistent manner to allow a consistent PFOT interpretation (i.e. to assess the stimulation effect on the fluid-flow system in the formation) permitting the continued evaluation of the stimulation process.

Each stage ii fracture episode may commence with injection of clear water at a constant volume rate. Specific protocols for the injection rates may be provided, using the same value for each episode, and measuring the pressure build-up during the placement of a pre-slurry water pad over a 15 to 30+ minute period. If this step is done consistently, it can also be analyzed consistently as described below, giving confirmatory information about the changes in effective transmissivity and to a lesser degree the extent of the fluid-flow zone around the well. This is another measure used along with the others to execute the on-going process design as described below.

After the fine-grained proppant enhancement of the natural fracture system is generated through the above steps which may consist of multiple cycles of proppant injection, fall-off periods and clear water injection, a shut-in period of, preferably, no less than 12 hours is performed to assess the formation flow conditions and changes from the 12 hour shut-in after the baseline PFOT in stage i, including the decay rate of the pressure. This is analyzed with one or more methods, including multiple circumferential zones of different permeability, as well as a classical fracture wing length analysis. The PFOT analyses of the shut in data provides a quantitative assessment of the 'enhancement' of the natural fracture 10 system in terms of permeability fracture conductivity change, radius of volume change leading to conductivity improvements, and the development and improvements in the fluid flow components in the formation over time once injection is ceased (i.e. linear flow, bilinear flow, radial flow, boundary condition effects, etc).

The formation response information generated in the above steps is useful for refining and improving on the stage ii injection strategy and also for the design and stipulation of the injection strategy and proppant characteristics for the subsequent stage 3 injection activity.

The alteration of the stage ii injection strategy process can be through increasing or decreasing the injection rate and pressure parameters (as previously described), changing the proppant slurry concentration/injection characteristics (as previously described), changing the frequency and durations of the injection stages, and changing the frequency and durations of the overall injection cycles. Such alterations of the injection process can occur at any of the stages of injection of the method described herein, either severally or jointly.

Stage iii—Creating a Large Induced Fracture System as a Secondary Flow System

Stage iii consists of injection of a relatively coarser-grained slurry, in comparison with the stage ii slurry, into the formation after the conclusion of at least one round of stage ii. Stage iii generates an innermost region 70 within the formation immediately surrounding the injection well, as shown in FIGS. 8A, 9B and 11.

Stage iii injection is conducted at injection rates and injection pressure higher than in Stages i and ii, and the proppant use is coarser than in Stage ii. Injection rates are on the order of 6-10 bpm and proppant concentration is still less than 10%, 8%, 6% or 4% by volume in the slurry. These parameters for injection can vary widely depending on equipment, depth, stress and other factors, and it is contemplated that variants of the injection conditions and composition of this injected fluid may be adapted for use in any low permeability rock type to achieve the described mechanics of the present method.

One or more episodes of stage iii are conducted to create or induce a large fracture system that is in hydraulic communication with the induced fractures and the enhanced natural fracture system developed in stages i-ii. The present process allows for a large fracture system to be created by propagating a series of fracturing events in a controlled manner with good volumetric sweep of the formation in the near-wellbore area out into the formation—not with the use of a massive single fracture with large dimensions of great height and great length, which is often the goal that is stipulated in prior art.

It is preferable to allow the stage ii fracturing process to 'stabilize' before proceeding with stage iii. In most cases, after a relatively extended shut-in period following stage ii, the final injection stage comprising stage iii using a coarse-grained sand or particulate proppant material can be implemented. In some applications, the stage iii proppant constitutes a 16-32 mesh proppant or 20-40 or 40-60 mesh proppant, and in any case may be a proppant of grain diameter in the range of 200 to 2000 microns, comprising medium-grained to coarse-grained proppant classification sizes. However, the type of proppant in this stage is not critical, providing it is a relatively strong and reasonably rigid granular material that preferably consists entirely of moderately to well-rounded grains; quartz sand or synthetic (ceramic) proppant can be used. One aspect of this stage is that the associated fracture water pads pre- and post-fracture water injection periods are carefully done in a consistent manner with full pressure and rate measurements so as to reduce the chances of plugging the injection well and formation, and to improve the chances of analyzing the data in a useful manner.

Stage iii generates fluid pathways that lead outwardly to the fractures within zones 72 and 38 from the well bore, and the resources within the formation can flow from these remote fractures towards the well for extraction. In later injection cycles (repeating of Stages i to iii), the stage iii pathways permit particulate-free fracturing fluid to flow into zone 38 and beyond to extend the zone of self-propping fractures by the mechanisms described in the present method, and the resources within the formation can flow from these remote fractures towards the well for extraction. Thereby progressively expanding the overall stimulated rock volume 99 as described below.

Issues that can be addressed in order to ensure an optimal proppant selection in terms of size and concentration for the stage iii induced fracture system include:

i. fracture propping issues—the nature of the pressure-time-propping process that leads to induced fractures 11 of wide aperture, with the success being linked to the width of the near-wellbore induced fractures 11 and to the degree of interconnectedness of the induced fractures 11 and the natural fractures 10. In this case, FIG. 9B and Figure to depict the desired effect of stage iii, with shorter, wider fractures containing coarse-grained proppant being created relatively close to the wellbore 36 and connecting with the stimulated networks beyond, generated during stages i and ii.

ii. placement issues—the success of the proppant placement process in terms of the consistency of proppant placement far into the induced and enhanced natural fracture system.

iii. conductivity issues—the magnitude and extent of the improvement of flow capacity of the region around the treatment point as the result of the combination of the enhanced natural and incipient fracture through aperture propping, shear displacement and self-propping, and interconnection with the hydraulically induced fractures and the wellbore 36.

iv. in situ stress changes—the changes in the fracturing pressure in the near-wellbore vicinity as measured by step-rate tests, or as estimated by fracture flow-back or PFOTs. Specifically, the significant additional volume change implemented during Stage iii will have effects on formation stresses that are a function of the magnitude of the volume change in the region nearer to the wellbore 36. One aspect of stage iii is to control and optimize this volume-stress change in order to facilitate stress rotations and fracture rotations. Such mechanisms are important to progressively expand and optimize the stimulated rock volume 99.

The coarse-grained proppant in stage iii should be injected more aggressively than the fine-grained proppant of stage ii, and in general a higher injection rate of 5 bpm or more, and as high as 10 bpm or more, if the physical facilities so permit, may be employed so as to avoid any premature blockages and to establish a good hydraulic communication with the enhanced network generated in stages 1 and 2.

Before and during stage iii, the pressure monitoring and other monitoring steps associated with stages i and ii are continued and repeated in essentially the same manner; injection of stage iii occurs in the same manner of pre-fracture pad, and post-fracture shut-in to permit a comparison of the formation responses between stages ii and iii. Once proppant placement is finished, one may repeat the PFOT analysis of the post-fracture stage for a minimum of 8-12 hours, although one may extend the shut in period for a longer time to allow the effect of the more remote propped fractures to be assessed.

Once the pressure decay data has been collected, a SRT stress measurement may be performed after the last active injection before full flow-back and attempting to bring the well on production.

Using the present process during stage iii, the overall volume of proppant pumped during the various stages can be more important than the concentration of proppant pumped; i.e., depending on injection rate, one can inject more proppant volume with longer periods of injection time at lower proppant concentrations. Specific values of proppant concentration and injection rate during stages ii and iii are determined through consistent analysis of the data collected during the treatment process starting from the initial step-rate tests carried out before stage i, and including all data analyses subsequent to that test.

Stage iv

A stage iv may occur after Stage iii. Stage iv essentially comprises a repeat of stage i, optionally with modification of some of the injection parameters, comprising injection of a non-slurry solution under similar parameters as stage i. The objective of the stage iv is to use the stage ii and iii fracture networks to further extend the stimulated rock volume (99) by expanding zone 38 comprising enhanced self-propped natural fractures. In one embodiment, Stage iv essentially comprises a repeating of stage i and stage ii, optionally with modification of some of the injection parameters, to achieve the mechanism of the present process. This effect will increase the drainage area of the resource to be extracted from the formation, and to facilitate the development of the mechanisms described herein with subsequent injection cycles (i.e. cycling of the stages).

Cycling of Stages and Integration of Stages

The increased pore pressure and changing effective stress state generated in stage i facilitate the opening and shear displacement of the natural fractures 10 to form open natural fractures 69, as depicted in FIGS. 6, 7, 8, 10 and 11, so that the opposing surfaces no longer close fully or match perfectly upon closure, leaving a remnant high permeability channel because of the shear displacement and dilation, as depicted in FIG. 15. This latter process of shear displacement and permanent dilation of the natural fracture 10 network is referred to as self-propping, and it leaves a remnant network 38 of high permeability channels interconnected with the hydraulically induced fracture network 70, 72 (FIGS. 9, 10) that optimize the stimulated rock volume 99 (as described herein) and facilitate the flow of oil and gas to the production wellbore. It is part of the present method to continue to inject clear water at the rate and pressures identified herein so that the process propagates outward from the injection point and creates a large volume of interconnected and opened natural fractures 69 that form an extensive drainage area 38 around the injection point through the mechanisms described herein. Thereby progressively expanding the stimulated rock volume 99 from the near-well area further out into the formation.

The present method may comprise repeated cycles and/or subcycles, which may consist of the following:

1. repetition of any individual stage before proceeding with the nextstage;

2. sequentially repeating any two stages, before proceeding with the next stage, for example stages i and ii may be repeated in sequence multiple times, before proceeding to stage iii; or stages ii and iii may be repeated multiple times before concluding the process or proceeding back to stage i; or stages iii and i may be repeated in sequence multiple times, before proceeding to stage ii.

3. sequentially repeating all 3 stages, for a selected multiple number of times.

4. Changing the injection parameters or extents of the injection or shut-in periods.

Stages i through iii (and optionally stage iv) are collectively considered a complete "fracture cycle". In one embodiment, a production period for resource extraction from the formation is provided between repetitions of the fracture cycle. In another embodiment, a shut-in time is provided between repetitions of the fracture cycle. In one embodiment, the shut-in time is at least 24 hours. This shut-in period allows for one or more of the following:

i. In situ stress redistribution/stabilization.

ii. Facilitation of fracture rotation.

iii. Evaluation of formation response using PFOT to assess improvement in overall formation permeability.

iv. Maximizing or managing formation shear stress development which can lead to shear movements in shale and subsequent improvements in self-propping activity.

It may be necessary to minimize large-scale shear stress concentrations along lithological interfaces that may have a possible impact on wellbore integrity, especially for vertical wells that are prone to shear along horizontal geological interfaces.

The shut-in time between cycles can be based on the following parameters:

i. Volume of fluid and proppant pumped ii. Duration of pumping iii. Change in fluid flow characteristics of the formation The stages can be repeated individually or together within a cycle as necessary depending on the results of the fracture enhancements. For example, several sub-cycles of stage i and ii may be applied for effective enhancement and propping the natural fracture network. The entire cycle of stages i-iii can be repeated to effectively develop a large hydraulic communication and drainage area that develops from the wellbore 36 out into the formation in a controlled manner.

It may also be desirable to increase the concentration of the proppant at the end of last stage iii to 'pack-off' the wellbore 36 area in order to create a highly conductive path around the wellbore 36 allowing for good flow from all flow systems into the wellbore 36 (FIG. 3). In prior art this process has been referred to as "forced fracture tip screen-out" or "frac-'n-pack"

The injection strategy with each additional stage/cycle may vary as the number of cycles increases. For example, a coarse-grained proppant (20-40 grain size) may be used in stage iii during the initial cycles. The proppant may change to 60-40 grain size for stage iii in later cycles. A coarser-grained proppant may be used for stage ii in subsequent cycles, compared to the first cycle in the sequence of stage ii.

The application of repeated cycles and stages as described herein carries the fine-grained proppant of stage ii deeply into the formation to sequentially extend zone 72. Proppant deposits within the formation cause increases in local formation stresses with each cycle. Local formation stresses of this nature cause reorientation of new fractures generated in a subsequent cycle when opening of natural fractures 10 is re-initiated through the use of high pressure slurry injection, resulting in the fracture rotation illustrated schematically in FIGS. 9 and 10. The use of a low density slurry combined with relatively low injection rates and pressures, and the injection sequences of stages i-iii, combine to generate significant opening of self-propping fractures in zone 38 via processes of fracture rotation and wedging.

FIGS. 8 to 11 depict the consequences of a typical fracture stimulated zone generated by the application of stages i-iii, namely the overall dilated (stimulated) zone 99, some of it propped, some not, resulting from the present process. Zone 99 can in some cases be extended by optional stage iv which consists of a further injection into the formation following stage iii. Zone 99 is characterized by a high permeability and approximately a lenticular or ellipsoidal shape. Zone 99 comprises an innermost zone 70 characterized by wide, propped fractures generated in stage iii. Intermediate zone 72 is characterized by narrower propped fractures generated in stages i and ii. Outermost zone 38 is characterized by self-propping fractures generated by stage i and optionally stage iv and/or further cycling of stages i-iii.

Stimulated zone 99 is characterized by enhanced flow properties, resulting from the dilated natural fractures, as well as the connection and opening of the aperture of intersecting pre-existing fissures and fractures as a result of the influx of water and the introduction of a proppant. Additionally, the natural fractures 10 and incipient fractures 12 can shear and dilate under the effects of the present method, and even if not physically opening, they can be displaced as the result of large shearing stresses and elevated pore pressures. Such fractures will not likely close when $\Delta p$ equals 0, although such fractures that are not propped open may still be sensitive to changes during hydrocarbon depletion (hence the need for crystallization of these enhanced natural fractures during stage ii, as described herein).

A resource contained within the formation may be extracted through the self-propped and propped fracture networks generated by the present method. Typically, the resource is extracted after the completion of stage iii or after stage iv. However, the resource may also be extracted after completion of any one of the stages herein. As the zones of propped and self-propped fractures extends progressively more remote from the injection side upon repeated cycles, the resource may be drawn from progressively more remote zones.

FIG. 12 depicts an individual injection wellbore 36, showing the manner in which the open hydraulically induced fractures may rise out of the immediate injection zone generated at the injection site if the geological conditions so permit, but with the proppant being retarded and staying in the target zone 94. The present process also restricts the rise of the sand proppant by virtue of using only low-viscosity water as a liquid agent to affect the opening of the natural fracture network 10. FIG. 13 schematically shows one approach to monitoring formation response to the injection process described herein. The monitoring response comprises any combination of pressure sensors located on the injection well 36 and injection system, surface $\Delta\theta$ tiltmeters 112, and shallow $\Delta\theta$ tiltmeters 114 located at increasing distances from the injection well 36; and microseismic sensors comprising geophones 108 or accelerometers that can collect vibrational energy emissions arising from stick-slip shear displacements in the rock mass. An offset $\Delta p$ monitoring well 106 may be positioned remotely from the injection well 36, at a distance which is distant from the expected dilated zone 38, 99 within the formation. The offset $\Delta p$ monitoring wells 106 comprises geophones 108, accelerometers, and pressure gauges 110 located strategically along the length of the said monitoring well 106, for detecting changes in pressure within the formation, and for collecting vibrational energy responses. The instrumentation in the monitor well 106 or wells can also detect changes in pressure resulting from fracture fluid leak-off 24 of injection fluid from the injection well 36.

FIG. 14 depicts deformation monitoring techniques, comprising an array of shallow $\Delta\theta$ tiltmeters 114 and deep $\Delta\theta$ tiltmeters 116 located at varying distances from the injection well 36, intended to detect changes in the deformation fields associated with the volume changes induced in the hydrocarbon reservoir by the present method. The tiltmeter wells can comprise means to detect displacement of the surface and the overburden formations to an accuracy sufficient to analyse the data and determine the aspect and magnitude of the induced dilation of the natural fracture 10 system. In addition, various surface surveys may be conducted to detect surface level changes, including surface surveys, satellite imagery and aerial photography 120.

FIGS. 16A and B depict changes in bottom-hole pressure that occur when the present process is applied in a multiple cycles extending over protracted periods extending over multiple days and months.

In a further aspect, the particulate-containing injectate injected in stages ii and/or iii may comprise a slurry that incorporates a waste substance, such as contaminated sand or other wastes. This serves the dual purposes of enhancing hydrocarbon production, as well as a convenient means to dispose of granular operational wastes in a permanent fashion, constituting a novel approach to achieve multiple goals.

The present invention has been described herein by way of detailed descriptions of embodiments and aspects thereof. Persons skilled in the art will understand that the present invention is not limited in its scope to the particular embodiments and aspects, including individual steps, processes, components, and the like. The present invention is best understood by reference to this patent specification as a whole, including the claims thereof, and including certain functional or mechanical equivalents and substitutions of elements described herein.

The invention claimed is:

1. A method of generating an enhanced fracture network in a rock formation, said formation characterized by a network of native fractures and incipient fractures and a minimum hydraulic fracture initiation pressure and rate, said method comprising the sequential stages of:

i) injecting a non-slurry aqueous solution into a well extending into the formation at a rate and pressure which is slightly above the minimum hydraulic fracture initiation pressure and rate of said formation and under conditions suitable for promoting increased pore pressure, shearing, dilation and hydraulic communication of the native fractures and incipient fractures, wherein said stage i dilates the native fractures with aperture opening and/or shear displacement of the native fractures to generate an outer zone essentially comprising self-propping fractures wherein high permeability paths connecting to the injection well are formed, and wherein said stage i is performed until no further stimulation of the formation occurs as determined by formation response measurement data;

ii) injecting a first slurry comprising relatively fine grains of proppant into said formation to prop fractures generated in said stage i within an intermediate zone located within and surrounded by the outer zone generated in stage i; and iii) injecting a second slurry comprising relatively coarse grains of proppant into said formation to generate large fractures within an inner zone surrounded by and within the intermediate zone, in communication with the fractures generated in said stages i and ii.

2. The method of claim 1 comprising a further step iv of further extending and propagating the outer zone by additional injection of non-slurry aqueous solution through fractures generated in said stages i, ii and iii at a rate which is slightly above the minimum hydraulic fracture initiation pressure.

3. The method of claim 1 wherein said stages ii and/or iii further comprise controlling and optimizing formation volume change resulting from said stages ii and/or iii in order to generate rotation and/or wedging of blocks within the formation.

4. The method of claim 1 comprising cycling sequentially for a plurality of cycles of stages i through iii, or repeating any one or more of stages i through iii, or repeating any pair of stages i, ii or iii.

5. The method of claim 1 wherein said aqueous solution comprises water or saline that is essentially free of additives.

6. The method of claim 1 wherein any one of said stages follows a preceding one of said stages with essentially no time gap.

7. The method of claim 1 wherein any one of said stages follows a preceding one of said stages with a shut-in period between said stages.

8. The method of claim 1 wherein each of said stages ii and/or iii comprises a sequence of discrete water injection episodes followed by episodes of injection of said first slurry or said second slurry.

9. The method of claim 1 comprising performing a plurality of cycles each comprising stages i through iii and providing a shut-in period or resource production period between said cycles.

10. The method of claim 1 comprising extraction of one or more of crude oil, hydrocarbon gas or geothermal energy.

11. The method of claim 1 wherein said formation has a permeability of less than 10 milliDarcy.

12. The method of claim 1 wherein said slurry of stages ii and/or iii further comprises a waste substance.

13. The method of claim 1 wherein a resource is extracted from zones within the formation, wherein said zones comprise fractures that are affected by said stages and are progressively more remote from the well with each repeated application of said stages.

14. The method of claim 1 wherein the injection rate and pressure in said stage i is above the minimum hydraulic fracture initiation pressure and rate of said formation by an amount which is up to 10%.

15. The method of claim 1 wherein the injection rate and pressure in said stage ii is 10% to 30% above the injection rate and pressure in stage i.

16. The method of claim 1 wherein the injection rate and pressure in said stage iii is 50% to 100% above the injection rate and pressure in stage i.

17. The method of claim 1 wherein said first slurry and/or said second slurry comprise about 4% to 10% solid particulates by volume.

18. A method of generating an enhanced fracture network in a rock formation, said formation characterized by a network of native fractures and incipient fractures and a minimum hydraulic fracture initiation pressure and rate, said method comprising the sequential stages of:

i) injecting a non-slurry aqueous solution into a well extending into the formation at a rate and pressure which is slightly below or at the minimum hydraulic fracture initiation pressure and rate of said formation and under conditions suitable for promoting increased pore pressure, shearing, dilation and hydraulic communication of the native fractures and incipient fractures, wherein said stage i dilates the native fractures with aperture opening and/or shear displacement of the native fractures to generate an outer zone essentially comprising self-propping fractures wherein high permeability paths connecting to the injection well are formed, and wherein said stage i is performed until no further stimulation of the formation occurs as determined by formation response measurement data;

ii) injecting a first slurry comprising relatively fine grains of proppant into said formation to prop fractures generated in said stage i within an intermediate zone located within and surrounded by the outer zone as generated in stage i; and iii) injecting a second slurry comprising relatively coarse grains of proppant into said formation to generate large fractures within an inner zone surrounded by and within the intermediate zone, in communication with the fractures generated in said stages i and ii.

19. The method of claim 18 comprising the further step iv of further extending and propagating the outer zone by additional injection of non-slurry aqueous solution through fractures generated in said stages i, ii and iii at a rate which is slightly below or at the minimum hydraulic fracture initiation pressure for dilating the native fractures with aperture opening and/or shear displacement.

20. The method of claim 18, wherein the injection rate and pressure in said stage ii is 10% to 30% above the injection rate and pressure in stage i.

21. The method of claim 18 wherein said stages ii and/or iii further comprise controlling and optimizing formation volume change resulting from said stages ii and/or iii in order to generate rotation and/or wedging of blocks within the formation.

22. The method of claim 18 comprising cycling sequentially for a plurality of cycles of stages i through iv, or repeating any one or more of stages i through iv, or repeating any pair of stages i, ii, iii or iv.

23. The method of claim 18 wherein said aqueous solution comprises water or saline that is essentially free of additives.

24. The method of claim 18 wherein any one of said stages follows a preceding one of said stages with essentially no time gap.

25. The method of claim 18 wherein any one of said stages follows a preceding one of said stages with a shut-in period between said stages.

26. The method of claim 18 wherein said stages ii and/or iii comprises a sequence of discrete water injection episodes followed by episodes of injection of said first slurry or said second slurry.

27. The method of claim 18 comprising performing a plurality of cycles each comprising stages i through iii and providing a shut-in period or resource production period between said cycles.

28. The method of claim 18 comprising extraction of one or more of crude oil, hydrocarbon gas or geothermal energy.

29. The method of claim 18 wherein said formation has a permeability of less than 10 milliDarcy.

30. The method of claim 18 wherein said first slurry and/or said second slurry comprise about 4% to 10% solid particulates by volume.

31. The method of claim 18 wherein said slurry of stages ii and/or iii further comprises a waste substance.

32. The method of claim 18 wherein a resource is extracted from zones within the formation wherein said zones comprise fractures that are affected by said stages and are progressively more remote from the well with each repeated application of said stages.

33. The method of claim 18 wherein the injection rate and pressure in stage i is 0 to 10% below the minimum hydraulic fracture initiation pressure and rate of said formation.

34. The method of claim 18 wherein the injection rate and pressure in said stage ii is 10% to 30% above the injection rate and pressure in stage i.

35. The method of claim 18 wherein the injection rate and pressure in said stage iii is 50% to 100% above the injection rate and pressure in stage i.

* * * * *